US010870270B2

(12) United States Patent
Iijima et al.

(10) Patent No.: US 10,870,270 B2
(45) Date of Patent: Dec. 22, 2020

(54) DROPLET DISCHARGE APPARATUS AND DROPLET DISCHARGE METHOD

(71) Applicant: RICOH COMPANY, LTD., Tokyo (JP)

(72) Inventors: Hideaki Iijima, Kanagawa (JP); Tetsuyoshi Nakata, Kanagawa (JP); Jun Watanabe, Tokyo (JP); Yasunari Harada, Kanagawa (JP); Toshiaki Hosokawa, Shiga (JP); Shunsuke Shitaoka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/929,044

(22) Filed: Sep. 19, 2018

(65) Prior Publication Data

US 2019/0143674 A1 May 16, 2019

(30) Foreign Application Priority Data

Nov. 14, 2017 (JP) ..... 2017-218873

(51) Int. Cl.
*B41J 3/36* (2006.01)
*B41J 2/045* (2006.01)
(Continued)

(52) U.S. Cl.
CPC ..... *B41J 2/04505* (2013.01); *B41J 2/04586* (2013.01); *B41J 3/36* (2013.01); *B41J 3/4075* (2013.01); *B41J 11/0095* (2013.01)

(58) Field of Classification Search
CPC ..... B41J 2/04505; B41J 3/36; B41J 11/0095; B41J 2/04586
See application file for complete search history.

(56) References Cited

U.S. PATENT DOCUMENTS

2017/0266955 A1 9/2017 Harada et al.
2017/0274644 A1 9/2017 Shinohara
2018/0001660 A1* 1/2018 Liao ..... B41J 29/393

FOREIGN PATENT DOCUMENTS

CN 107225854 A 10/2017
JP 2000-25284 A 1/2000
(Continued)

OTHER PUBLICATIONS

Extended European Search Report dated Apr. 15, 2019 in corresponding European Patent Application No. 18200135.4, 10 pages.
(Continued)

*Primary Examiner* — Sharon Polk
(74) *Attorney, Agent, or Firm* — Xsensus LLP

(57) ABSTRACT

A droplet discharge apparatus discharges a droplet to form an image on a recording medium while being moved by a user. The droplet discharge apparatus includes a head to discharge a droplet on a recording medium according to image data, a sensor to detect a movement amount of the droplet discharge apparatus in a predetermined period, and a processor. The processor is configured to instruct droplet discharge based on the image data and the movement amount detected by the sensor, determine floating of the droplet discharge apparatus from the recording medium based on information from the sensor, and stop the droplet discharge in response to a determination that the droplet discharge apparatus is floating.

12 Claims, 26 Drawing Sheets

(51) Int. Cl.
*B41J 11/00* (2006.01)
*B41J 3/407* (2006.01)

(56) References Cited

FOREIGN PATENT DOCUMENTS

| | | |
|---|---|---|
| JP | 2004-345187 | 12/2004 |
| JP | 2016/10969 A | 1/2016 |
| WO | WO 2016/12266 A1 | 8/2016 |

OTHER PUBLICATIONS

Office Action dated Dec. 18, 2019, issued in corresponding Chinese Patent Application No. CN201811296131.3, 6 pages.

* cited by examiner

FIG. 23

| RECORDING MEDIUM | DYNAMIC FRICTION COEFFICIENT |
|---|---|
| PAPER (LOW FRICTION) | 0.4 |
| PAPER (HIGH FRICTION) | 0.7 |
| CLOTH | 0.4 |
| NYLON | 0.2 |
| IRON | 0.5 |
| ALUMINUM | 0.8 |

DROPLET DISCHARGE APPARATUS AND DROPLET DISCHARGE METHOD

CROSS-REFERENCE TO RELATED APPLICATIONS

This patent application is based on and claims priority pursuant to 35 U.S.C. § 119(a) to Japanese Patent Application No. 2017-218873, filed on Nov. 14, 2017, in the Japan Patent Office, the entire disclosure of which is hereby incorporated by reference herein.

BACKGROUND

Technical Field

The present disclosure relates to a droplet discharge apparatus and a droplet discharge method.

Description of the Related Art

There are printers that have a sheet conveyance mechanism and discharge droplets such as ink droplets at a timing when a sheet being conveyed reaches an image formation position, to form an image. On the other hand, as small laptop computers (e.g., personal computers or PCs) and smart devices spread, the need for compactness and portability increases also in printers. One approach to make a printer more compact is eliminating the sheet conveyance mechanism from the printer. Handheld printers without the sheet conveyance mechanism are being put into practical use. Since the handheld printer does not include the sheet conveyance mechanism, while a user moves the handheld printer on a sheet surface, the handheld printer discharges ink.

SUMMARY

An embodiment of this disclosure provides a droplet discharge apparatus to discharge a droplet to form an image on a recording medium while being moved by a user. The droplet discharge apparatus includes a head to discharge a droplet on a recording medium according to image data, a sensor to detect a movement amount of the droplet discharge apparatus in a predetermined period, and a processor. The processor is configured to instruct droplet discharge based on the image data and the movement amount detected by the sensor, determine floating of the droplet discharge apparatus from the recording medium based on information from the sensor, and stop the droplet discharge in response to a determination that the droplet discharge apparatus is floating.

Another embodiment provides a droplet discharge apparatus to discharge a droplet to form an image on a recording medium while being moved by a user. The droplet discharge apparatus includes above-described head, the above-described sensor, an accelerometer to detect an acceleration applied to the droplet discharge apparatus, and a processor. The processor is configured to instruct droplet discharge based on the image data and the movement amount detected by the sensor, determine floating of the droplet discharge apparatus from the recording medium based on the acceleration detected by the accelerometer and a friction coefficient of the recording medium, and stop the droplet discharge in response to a determination that the droplet discharge apparatus is floating.

Yet another embodiment provides a droplet discharge method executed by a droplet discharge apparatus to form an image on a recording medium while being moved by a user. The method includes discharging a droplet onto the recording medium to according to image data; detecting, with a sensor, a movement amount of the droplet discharge apparatus in a predetermined period; instructing droplet discharge based on the image data and the movement amount detected; determining whether the droplet discharge apparatus is floating based on information from the sensor; and stopping the droplet discharge in response to a determination that the droplet discharge apparatus is floating.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 23 is a table illustrating friction coefficients designated to sheet types for the method of selecting the recording medium type to designate the friction coefficient according to an embodiment;

Figure 1:
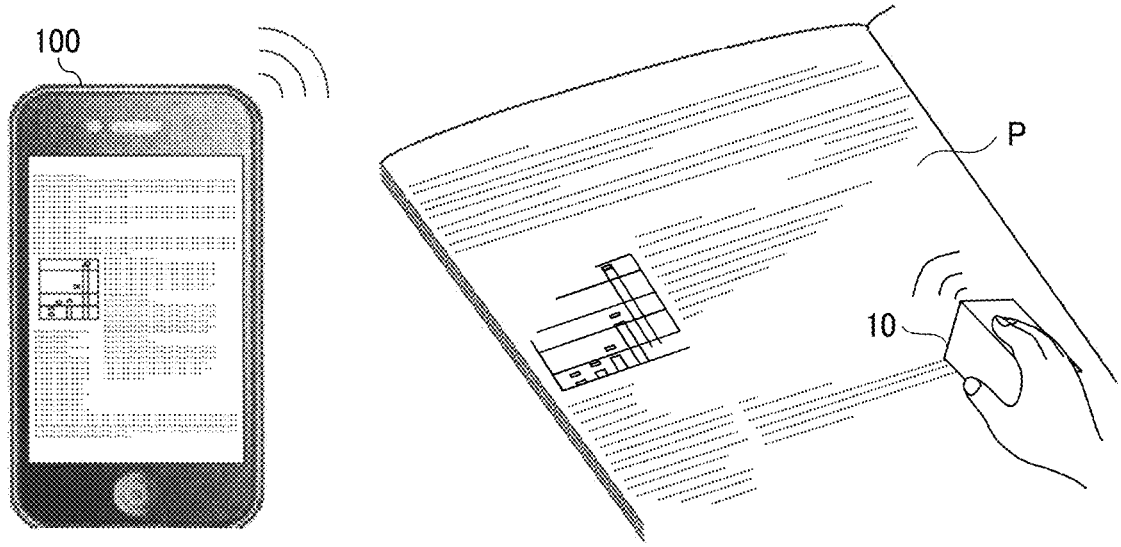
FIG. 1 is a diagram illustrating an example of printing using a handheld printer according to embodiments of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a liquid discharge apparatus according to embodiments of this disclosure is described. As used herein, the singular forms "a", "an", and "the" are intended to include the plural forms as well, unless the context clearly indicates otherwise.

FIG. 1 is a diagram illustrating an example of printing using a handheld printer 10 according to embodiments of the present disclosure. The handheld printer 10 receives image data from, for example, an image input device 100 (or an image data output device) such as a smart device or a personal computer (PC). Subsequently, as a user freely moves the handheld printer 10 two-dimensionally on a recording medium P (e.g., a paper sheet), that is, scans the recording medium P freehand with the handheld printer 10, the handheld printer 10 can form an image according to the image data. The recording medium P is, for example, a sheet of a notebook or a regular size paper sheet.

While the user moves the handheld printer 10 on the sheet, the handheld printer 10 may float from the sheet. If the handheld printer 10 floats from the sheet, the handheld printer 10 may continue printing with printing position deviated from an intended position.

According to an aspect of the present disclosure, in freehand moving of a handheld printer, floating of the handheld printer can be detected with a simple configuration.

As will be described later, the handheld printer 10 includes a navigation sensor 30 and a gyro sensor 17 to detect a position. The handheld printer 10 is configured to discharge the ink of the color to be applied to a target discharge position when the handheld printer 10 reaches the target discharge position. The portion to which the ink has already been applied is masked and becomes not an object of ink discharge. Accordingly, the user can move the handheld printer 10 freely with a hand in any direction on the recording medium P to form an image.

Figure 2:
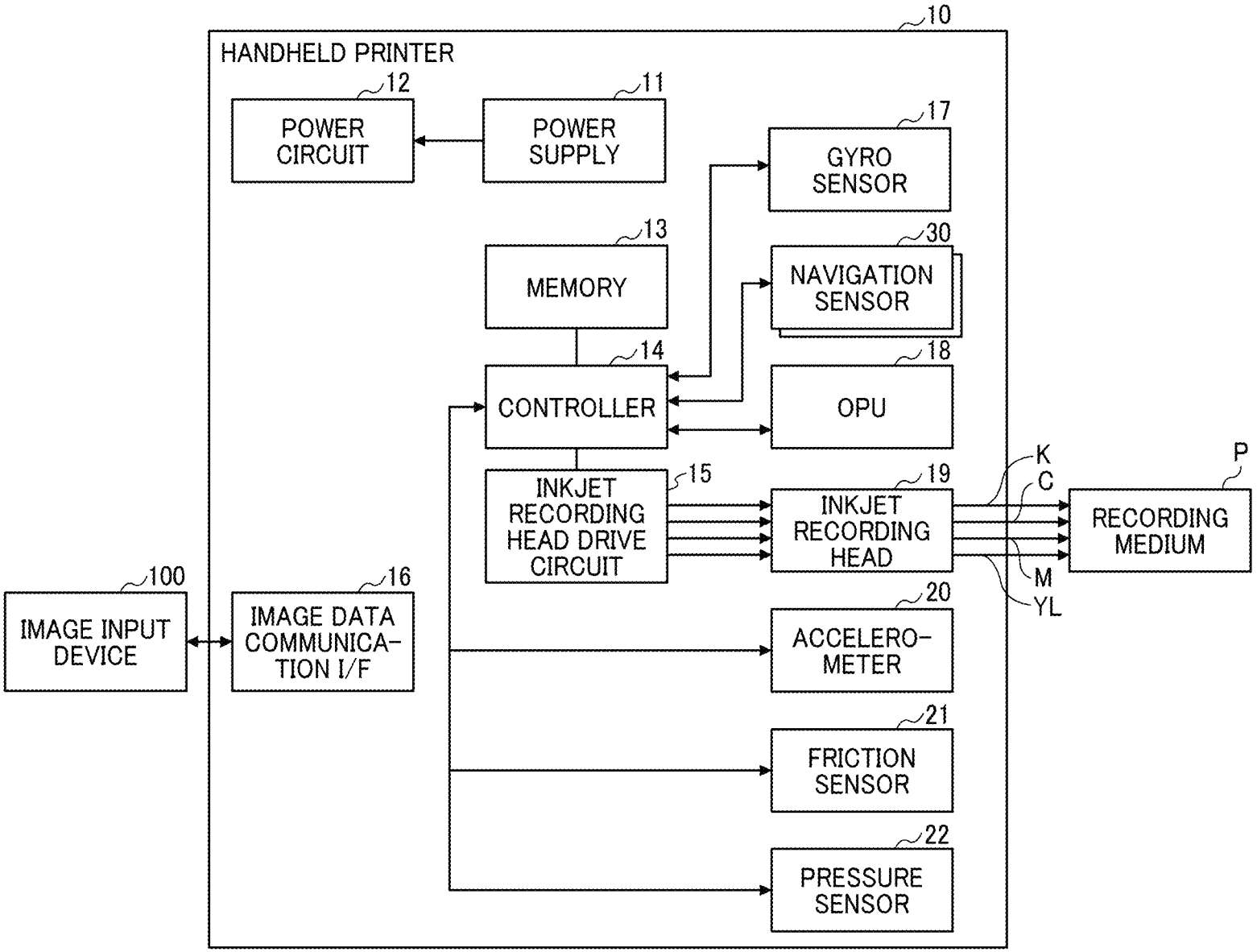
FIG. 2 is a block diagram illustrating a hardware structure of the handheld printer illustrated in FIG. 1.

FIG. 2 is a block diagram illustrating a hardware structure of the handheld printer 10 according to the present embodiment. The handheld printer 10 is an example of an image forming apparatus that forms an image on a recording medium and an example of a liquid discharge apparatus. The handheld printer 10 includes a power supply 11, a power circuit 12, a memory 13, a controller 14, an inkjet recording head drive circuit 15, an image data communication interface (I/F) 16, the gyro sensor 17, an operation panel unit (OPU) 18, an inkjet recording head 19, an accelerometer 20, a friction sensor 21, a pressure sensor 22, and the navigation sensor 30.

As the power supply 11, a battery is mainly used. A solar battery, an alternating-current (AC) commercial power supply, a fuel cell, or the like may be used. The power circuit 12 distributes the power supplied by the power supply 11 to each part of the handheld printer 10. Further, the power circuit 12 steps down or up the voltage of the power supply 11 to a voltage suitable for each part. When the power supply 11 is a rechargeable battery, the power circuit 12 detects the connection of, for example, an AC power supply and connects the AC power supply to a charging circuit of the battery to charge the power supply 11.

The memory 13 includes a read only memory (ROM) to store firmware for hardware control of the handheld printer 10, drive waveform data for the inkjet recording head 19, and other data necessary for initial setting of the handheld printer 10. The ROM can be any one, or a combination of two or more of, a mask ROM, a programmable ROM (PROM), an electrically erasable ROM (EEPROM), a flash memory, a memory card that is an external storage medium, and the like.

Further, the memory 13 includes a random access memory (RAM). The controller 14 uses the RAM as a work memory when executing the firmware. The RAM stores the image data received by the image data communication I/F 16 and is used to execute the expanded firmware. The RAM can be any one or a combination of two or more of a dynamic RAM (DRAM), a static RAM (SRAM), a synchronous DRAM (SDRAM), and the like.

The controller 14 includes a wired logic circuit included in a central processing unit (CPU) 101, an application specific integrated circuit (ASIC), a field-programmable gate array (FPGA), and the like and controls the entire handheld printer 10. For example, the controller 14 determines the position of each nozzle of the inkjet recording head 19 based on a movement amount and an angular speed detected by the navigation sensor 30 and the angular speed detected by the gyro sensor 17 so that the ink is discharged according to the position, thereby forming an image. Further, the controller 14 determines whether the handheld printer 10 is floating based on information acquired from the accelerometer 20, the friction sensor 21, and the pressure sensor 22. The controller 14 is described in further detail later.

The inkjet recording head drive circuit 15 generates a drive waveform for driving the inkjet recording head 19 using the drive waveform data supplied from the controller 14. The inkjet recording head drive circuit 15 can generate a drive waveform corresponding to the size of ink droplet and the like.

The inkjet recording head 19 is a head to discharge ink and includes a plurality of nozzles. In FIG. 2, the inkjet recording head 19 is configured to discharge inks of four colors, namely, cyan (C), magenta (M), yellow (YL), and black (B). Alternatively, the inkjet recording head 19 can be configured to discharge single color ink or five or more color inks. The inkjet recording head 19 includes a plurality of ink discharge nozzles arranged in one array or a plurality of arrays for each color. The ink discharge method can be, for example, a piezo method or a thermal method but not limited thereto.

The image data communication I/F 16 receives image data from the image input device 100 such as a personal computer (PC or client computer) or a smart device. The image data communication I/F 16 supports communication standards such as wireless local area network (LAN), Bluetooth (registered trademark), near field communication (NFC), infrared communication, and third generation (3G) or long term evolution (LTE), which are communication schemes for mobile phones. In addition to such wireless communication, the image data communication I/F 16 can be a communication device compatible with wired communication employing a wired LAN, a universal serial bus (USB) cable, or the like.

The gyro sensor 17 is a sensor to detect the angular speed of the handheld printer 10 when the handheld printer 10 rotates around an axis perpendicular to the recording medium P. Note that the gyro sensor 17 is not indispensable, and the handheld printer 10 may be without the gyro sensor 17. In a configuration in which the handheld printer 10 does not includes the gyro sensor 17, the handheld printer 10 can include a plurality of navigation sensors 30 to calculate the angular speed from the detection results of the plurality of navigation sensors 30.

The OPU 18 includes a light emitting diode (LED) to indicate a status of the handheld printer 10, a liquid crystal display, a touch panel for the user to instruct the handheld printer 10 to form an image, and the like. The OPU 18 can further have a voice input function.

The navigation sensor 30 is a sensor to detect the amount of movement of the handheld printer 10 in each predetermined cycle time. The navigation sensor 30 includes, for example, a light source 38 (illustrated in FIG. 4), such as a light emitting diode (LED) or a semiconductor laser, and an image sensor to capture an image of the recording medium P. As the user moves the handheld printer 10 on the recording medium P, the navigation sensor 30 sequentially captures or detects minute edges of the recording medium P. The handheld printer 10 analyzes the distance between the edges to obtain the travel distance of the handheld printer 10. In the present embodiment, two navigation sensors 30 can be mounted on the bottom face of the handheld printer 10 for the calculation of the movement amount and the angular speed. Alternatively, one navigation sensor 30 can be mounted on the bottom face of the handheld printer 10 for the calculation of the movement amount, and the angular speed can be calculated based on the detection by the gyro sensor 17. Details of the navigation sensor 30 will be described later. Yet alternatively, the handheld printer 10 can include a multi-axis accelerometer as the navigation sensor 30 to detect the movement amount based on the detection by the multi-axis accelerometer.

The accelerometer 20 is a sensor to measure the acceleration applied to the handheld printer 10. The measured acceleration is used for determining the floating of the handheld printer 10.

The friction sensor 21 is a sensor to acquire information for calculating a friction coefficient between the handheld printer 10 and the recording medium P. For example, the friction sensor 21 can use a spring and a linear encoder sensor for the measurement (details will be described later). The calculated friction coefficient is used for determination of floating of the handheld printer 10.

The pressure sensor 22 is a sensor to measure a force with which the handheld printer 10 is pressed against the recording medium P (details will be described later). The measured force is used for determination of floating of the handheld printer 10.

Figure 3:
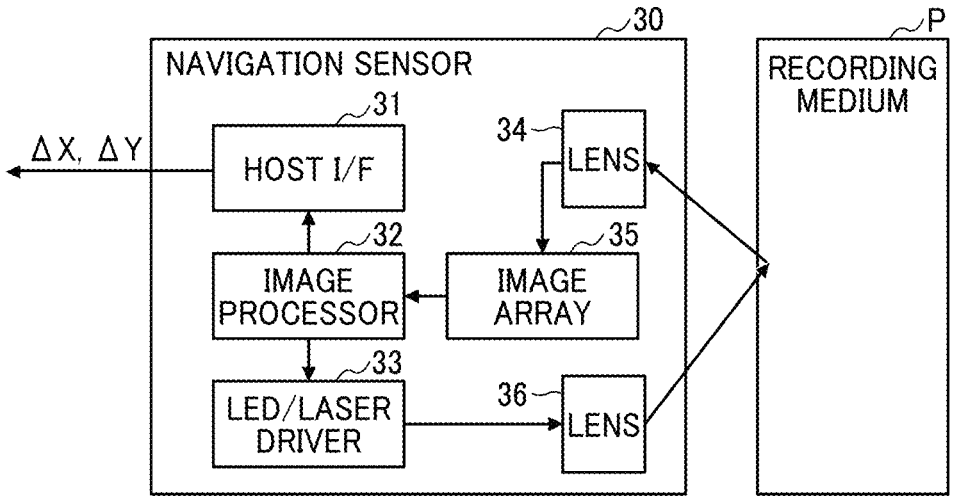
FIG. 3 is a block diagram of a hardware configuration of a navigation sensor of the handheld printer illustrated in FIG. 1.

FIG. 3 is a block diagram of a hardware configuration of the navigation sensor 30. The navigation sensor 30 includes a host I/F 31, an image processor 32, an LED/laser driver 33, a lens 34, an light-receiving element array 35, and a lens 36. The LED/laser driver 33 includes the light source 38 (illustrated in FIG. 4) such as an LED or a semiconductor laser and a control circuit integrated with each other and irradiates the recording medium P via a lens 36 with light according to a command from the image processor 32. The light-receiving element array 35 receives light reflected from the recording medium P through the lens 34. The two lenses (the lenses 34 and 36) are used to adjust an optical focus on the surface of the recording medium P.

Figure 4:
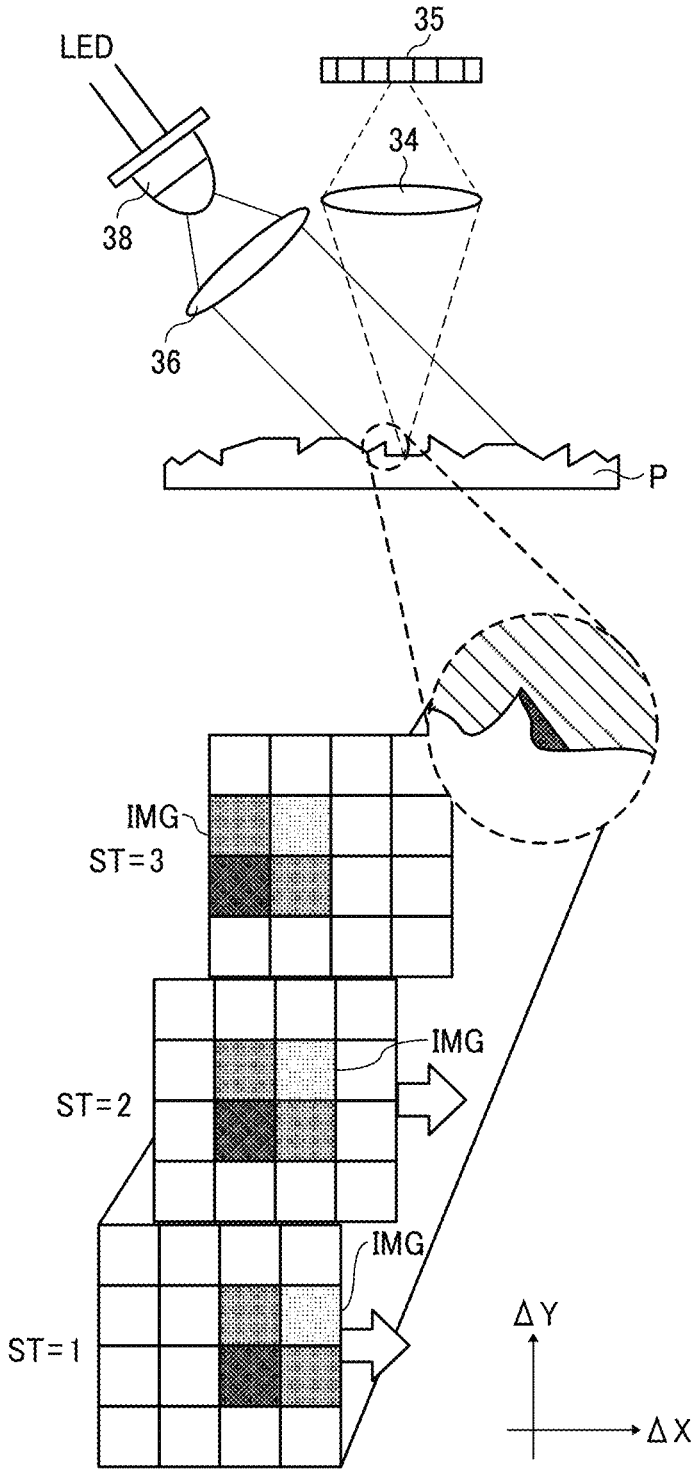
FIG. 4 is a diagram for explaining the function of the navigation sensor illustrated in FIG. 3.

The light-receiving element array 35 (a light-receiving sensor) includes a light-receiving element such as a photodiode sensitive to a wavelength of light and generates image data from the received light. The image processor 32 acquires the image data from the light-receiving element array 35 and calculates the distance (movement amount) by which the navigation sensor 30 has moved, based on the image data. In FIG. 4, a movement amount $\Delta X$ represents the amount of movement in the X-axis direction, and a movement amount $\Delta Y$ represents the amount of movement in the Y-axis direction. The image processor 32 outputs the calculated movement amounts to the controller 14 via the host I/F 31.

As the light source 38, LEDs are useful to irradiate a recording medium having a rough surface, such as paper. When irradiated, the rough surface creates shades to be used as characterizing portions. With the characterizing portions, the amount of movements in the X-axis direction and the Y-axis direction can be calculated accurately. On the other hand, to irradiate a recording medium having a smooth surface or is transparent recording medium, a laser diode (LD) that emits laser light can be used as the light source. The semiconductor laser can create, for example, a striped pattern or the like as a characterizing portion on the recording medium. With the characterizing portion, the amount of movement can be calculated accurately.

FIG. 4 is a diagram for explaining a function of the navigation sensor 30. Referring to FIGS. 3 and 4, the image processor 32 acquires, at each predetermined sampling timing ST (i.e., in each predetermined period), the data from the light-receiving element array 35 that has received the reflected light from the recording medium P and matrixes the acquired data in predetermined resolution units. The image processor 32 then detects a difference between the data acquired at an immediately preceding sampling timing ST and the data acquired at the current sampling timing ST and calculates the movement amount.

For example, in the example illustrated in FIG. 4, an image IMG represented by black or gray patches moves as time elapses from a certain sampling timing ST being "1" (hereinafter "ST1") to the subsequent sampling timing ST being "2" (hereinafter "ST2") and to the subsequent sampling timing ST being "3" (hereinafter "ST3").

Assuming that the sampling timing ST1 is a reference, output values, that is, movement amounts (ΔX, ΔY) at the sampling timing ST2 are expressed as (1, 0). The movement amounts ΔX and ΔY indicate amounts of movement in the horizontal direction and the vertical direction, respectively, with reference to the orientation of the navigation sensor 30. In a configuration where one navigation sensor 30 is used, even if the navigation sensor 30 rotates on the recording medium P, the rotational component is not detected. The resolution of amount of movement depends on a requirement of the device on which the navigation sensor 30 is mounted. Assuming that the navigation sensor 30 is mounted on a printer, for example, a resolution of about 1200 dpi is required.

Figure 5:
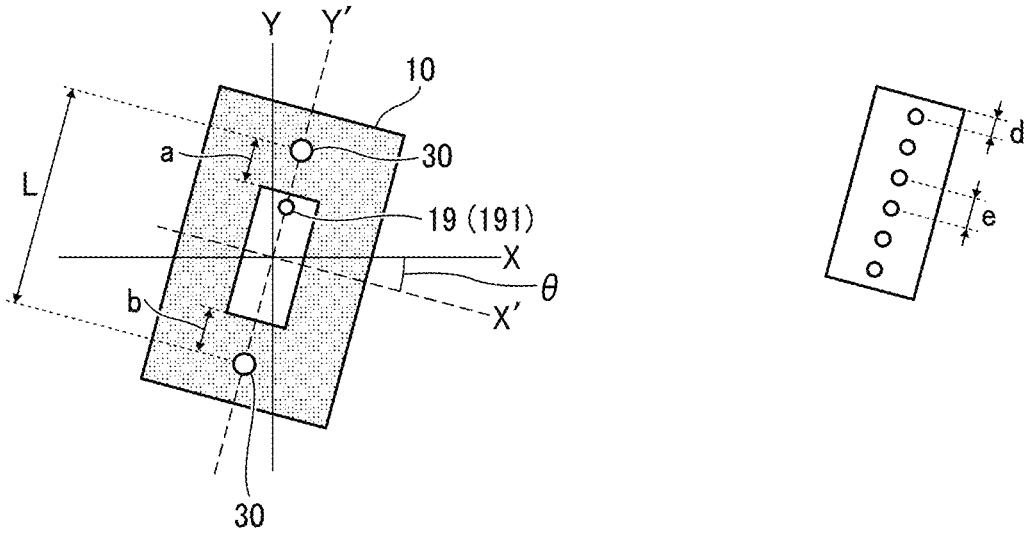
FIG. 5 is a view for explaining the arrangement of the navigation sensor and an inkjet recording head, according to an embodiment.

FIG. 5 is a plan view from the bottom of the handheld printer 10 for explaining the arrangement of the navigation sensor 30 and the inkjet recording head 19. FIG. 5 illustrates a configuration where two navigation sensors 30 are mounted on the bottom of the handheld printer 10. In FIG. 5, the navigation sensors 30 are disposed at a distance L from each other. In position calculation to be described with reference to FIG. 6, a calculation error decreases as the distance L increases.

Further, one navigation sensor 30 is disposed at a distance a from one end the inkjet recording head 19 in the longitudinal direction of the inkjet recording head 19, and the other navigation sensor 30 is disposed at a distance b from the other end of the inkjet recording head 19 as illustrated in FIG. 5. After the position of the navigation sensor 30 is calculated, each nozzle position is calculated using a distance d between a front end of the inkjet recording head 19 and a front-end nozzle 191 and a nozzle interval e.

Assume that, for example, the lateral direction and the longitudinal direction of the recording medium P are defined as the X-axis and the Y-axis and output axes of the navigation sensor 30 are an X'-axis and a Y'-axis. In this case, as illustrated in FIG. 5, when the handheld printer 10 is inclined by an angle θ on the recording medium P, the output values ΔX and ΔY of the navigation sensor 30 are, respectively, components in the horizontal direction and the vertical direction with respect to the X'-axis and the Y'-axis and no longer represent the amount of movement relative to the X-axis and the Y-axis of the recording medium P. Therefore, the navigation sensor 30 sequentially calculates the position with respect to the X-axis and the Y-axis of the recording medium P based on the output values on the X'-axis and the Y'-axis, thereby grasping a normal position of the navigation sensor 30.

Figure 6:
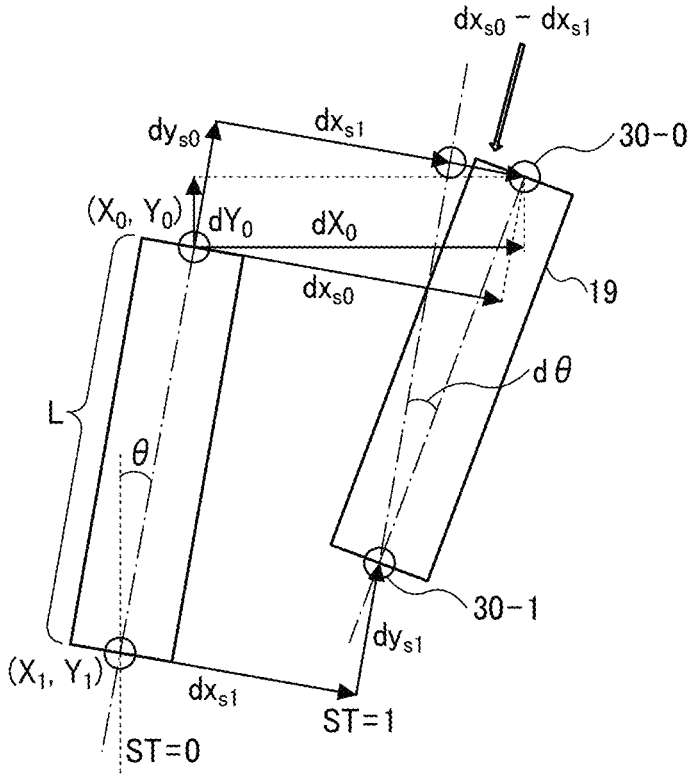
FIG. 6 is a diagram for explaining a calculation formula of a position of a navigation sensor, according to an embodiment.

FIG. 6 is a plan view for explaining a formula for calculating the position of the navigation sensor 30. In FIG. 6, the two navigation sensors 30 mounted at both ends of the inkjet recording head 19 are referred to as a navigation sensor 30-0 and a navigation sensor 30-1. Further, assume that the coordinates of the navigation sensor 30-0 on the recording medium are defined as $(X_0, Y_0)$, and coordinates of the navigation sensor 30-1 on the recording medium are defined as $(X_1, Y_1)$. In FIG. 6, a sampling timing ST being "0" (hereinafter "sampling timing ST0") serves as a reference. The navigation sensors 30 separate the position into two components, namely, a rotation component and a parallel component and calculate the position of the navigation sensor 30 at the next sampling time ST being "1" (sampling timing ST1) as follows, A difference dθ between the rotational components (hereinafter "rotational component difference dθ") illustrated in FIG. 6 is calculated from the difference between the output of the navigation sensor 30-0 and the output of the navigation sensor 30-1 in the X-axis direction according to Equation 1.

$$d\theta = \tan^{-1}\left(\frac{(dx_{s0} - dx_{s1})}{L}\right) \quad \text{Equation 1}$$

where $dx_{s0}$ is the output value of the navigation sensor 30-0 in the X-axis direction, $dx_{s1}$ is the output value of the navigation sensor 30-1 in the X-axis direction, and L is the distance between the navigation sensor 30-0 and the navigation sensor 30-1.

The parallel movement components $dX_0$ and $dY_0$ are calculated according to Equation 2, from the inclination θ of the inkjet recording head 19 at the sampling timing ST0 and the rotational component difference dθ at the sampling timing ST1 calculated according to Equation 1.

$$dX_0 = dx_{s0} \times \cos d\theta + dy_{s0} \times \sin d\theta$$

$$dY_0 = -dx_{s0} \times \sin d\theta + dy_{s0} \times \cos d\theta \quad \text{Equation 2}$$

Therefore, the position of the navigation sensor 30-0 at the sampling timing ST1 is obtained as $(X_0+dX_0, Y_0+dY_0)$. The coordinates $(X_1, Y_1)$ of the navigation sensor 30-1 at the sampling timing ST1 are calculated from the coordinates of the navigation sensor 30-0 at the sampling timing ST1, the inclination (θ+dθ) of the inkjet recording head 19 at the sampling timing ST1, and the distance L (the length of the inkjet recording head 19), according to Equation 3.

$$X_1 = X_0 - L \times \sin(\theta + d\theta)$$

$$Y_1 = Y_0 - L \times \cos(\theta + d\theta) \quad \text{Equation 3}$$

Further, the addition theorem and the approximation of sin(dθ)=tan(dθ)=dθ at a time when the difference dθ is extremely smaller than 1 (dθ<<1) are used in the calculation according to the above equation. The rotational component difference dθ is sufficiently small in sampling the movement amounts ΔX and ΔY detected by the navigation sensor 30 to calculate the actual position of the inkjet recording head 19.

For example, under conditions that the distance L is 1 inch (=25.4 mm), the scanning speed is as high as 400 mm/s, and the sampling period is 100 μs, the distance by which the inkjet recording head 19 moves in one sampling period is 40 μm. Under such conditions, when the distance L is the radius of the rotational motion, the maximum of the rotational component difference dθ (a maximum angle by which the inkjet recording head 19 can rotate) is expressed as $d\theta = 2\pi \times$ (movement distance on the circumference)/ (circumferential length)$=2\pi\times(40\times10^{-6})/(2\pi\times25.4\times10^{-3})=0.0015$ [rad]. When approximation is performed assuming that the rotational component difference dθ is extremely smaller than 1 (dθ<<1), sin(dθ) is 0.0015, and tan(dθ) is 0.0015.

For example, to calculate cos(θ+dθ) to obtain $Y_1$, calculation of sin(dθ) and cos(dθ) can be omitted and cos(θ+dθ) can be obtained with sin θ and cos θ as expressed in Equation 4 below.

$$\begin{aligned}\cos(\theta+d\theta) &= \cos\theta\times\cos(d\theta)-\sin\theta\times\sin(d\theta) \\ &= \cos\theta\times\sqrt{(1-\sin^2(d\theta))}-\sin\theta\times \\ &\quad \sin(d\theta)\ \because -90^\circ < d\theta < 90^\circ \\ &= \cos\theta\times\sqrt{(1-(d\theta)^2)}-\sin\theta\times \\ &\quad d\theta\ \ \because d\theta \ll 1 \\ &= \cos\theta\times\sqrt{\left(1-\left(\frac{dx_{s0}-dx_{s1}}{L}\right)^2\right)}- \\ &\quad \sin\theta\times(dx_{s0}-dx_{s1})/L\end{aligned} \qquad \text{Equation 4}$$

The handheld printer 10 repeats the above calculation at each sampling period, thereby sequentially grasping two-dimensional coordinates of the two navigation sensors 30 with respect to the recording medium P.

Figure 7:
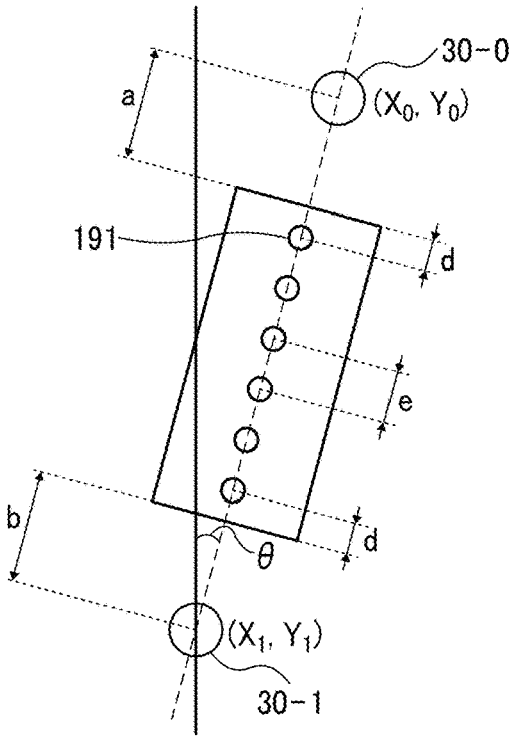
FIG. 7 is a diagram for explaining the calculation of the inkjet nozzle position, according to an embodiment.

FIG. 7 is a diagram for explaining the calculation of the inkjet nozzle position. The position of the navigation sensor 30 is calculated by the method described with reference to FIG. 6. Thereafter, using the distance a between the navigation sensor 30-0 and one end of the inkjet recording head 19, the distance b between the navigation sensor 30-1 and the other end of the inkjet recording head 19, the distance d between the front end of the inkjet recording head 19 and the front-end nozzle 191 (illustrated in FIG. 7), the nozzle interval e, and the inclination θ of the inkjet recording head 19, coordinates (NZL1_X, NZL1_Y) of the front-end nozzle 191 can be calculated from the position ($X_0$, $Y_0$) of the navigation sensor 30, according to Equation 5.

$$NZL_1_X=X_0-(a+d)\times\sin\theta$$

$$NZL_1_Y=Y_0-(a+d)\times\cos\theta \qquad \text{Equation 5}$$

Figure 8:
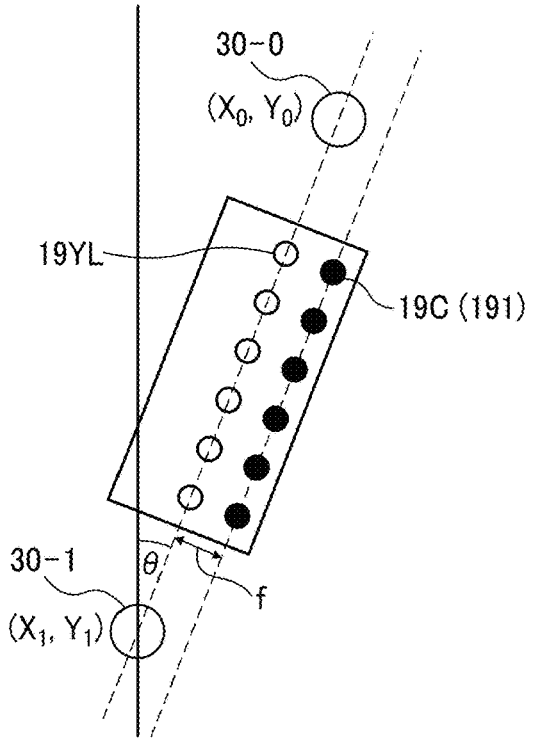
FIG. 8 is another diagram for explaining the calculation of the inkjet nozzle position.

FIG. 8 is another diagram for explaining the calculation of the inkjet nozzle position. As illustrated in FIG. 8, regarding a nozzle array (e.g., a nozzle array 19C) not aligned with a line extended from the navigation sensors 30 (30-0 and 30-1), coordinates ($NZL_{C-1}$_X, $NZL_{C-1}$_Y) of the front-end nozzle 191 on the nozzle array 19C can be obtained according to Equation 6, using a nozzle array interval f between the nozzle arrays (the nozzle arrays 19C and 19YL in FIG. 8), the distance a between the navigation sensor 30 and the inkjet recording head 19 illustrated in FIG. 7, the distance d between the end of the inkjet recording head 19 and the front-end nozzle 191.

$$NZL_{C-1}_X=X_0-(a+d)\times\sin\theta+f\times\cos\theta$$

$$NZL_{C-1}_Y=Y_0-(a+d)\times\cos\theta-f\times\sin\theta \qquad \text{Equation 6}$$

Figure 9:
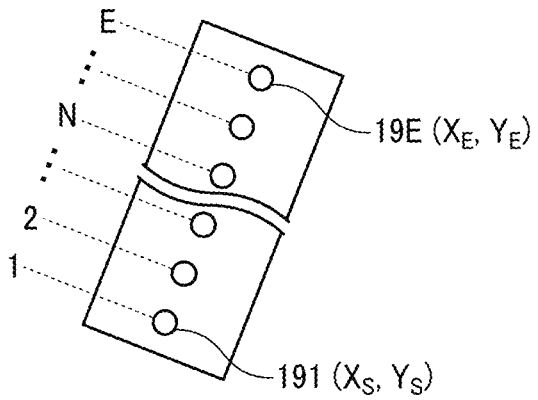
FIG. 9 is a diagram for explaining simple calculation of the inkjet nozzle position, according to an embodiment.

FIG. 9 is a diagram for explaining simple calculation of the inkjet nozzle position. As explained with reference to FIGS. 7 and 8, the coordinates of each nozzle can be calculated using a trigonometric function, but such calculation takes relatively long processing time. Accordingly, a description is given below of a method for calculating the coordinates of each nozzle with a simple proportional calculation.

In the nozzle arrays 19C and 19YL illustrated in FIG. 8, the nozzle interval e is equal. Accordingly, the coordinates ($NZL_{NX}$, $NZL_{NY}$) of a nozzle N can be calculated from the coordinates ($X_S$, $Y_S$) of the front-end nozzle 191 and coordinates ($X_E$, $Y_E$) of a rear-end nozzle 19E, according to Equation 7. where E is a total number of nozzles, and N represents an ordinal number of the nozzle counted from the front-end nozzle 191 to the rear-end nozzle 19E.

$$NZL_{N_X}=X_S+(X_E-X_S)/(E-1)\times N$$

$$NZL_{N_Y}=Y_S+(Y_E-Y_S)/(E-1)\times N \qquad \text{Equation 7}$$

Figure 10:
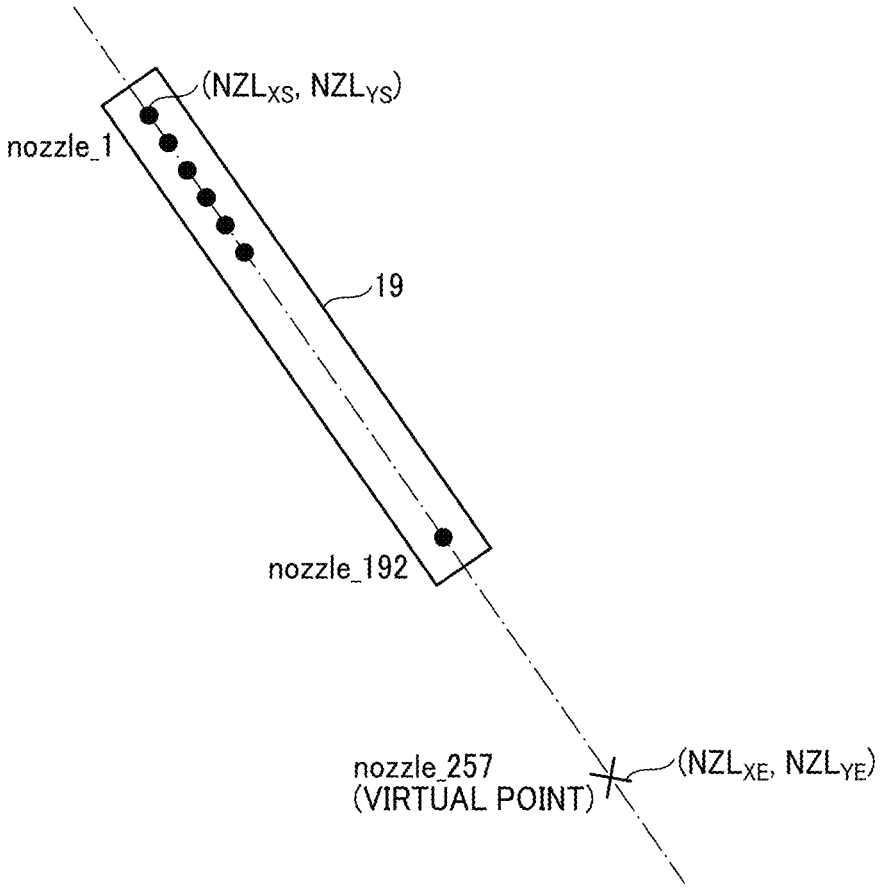
FIG. 10 is another diagram for explaining a simple calculation of the inkjet nozzle position, according to an embodiment.

FIG. 10 is another diagram for explaining a simple calculation of the inkjet nozzle position. The calculation is made simple as follows. To divide an entire nozzle array by a power of 2, a virtual point nozzle_257 is provided as illustrated in FIG. 10, and the coordinates of a point nozzle_1 to a point nozzle_192 where nozzles are actually arranged are calculated. The coordinates at the point nozzle_1 are ($NZL_{XS}$, $NZL_{YS}$) and the coordinates of the virtual point nozzle_257 are ($NZL_{XE}$, $NZL_{YE}$). According to Equation 8, the coordinates ($NZL_{NX}$, $NZL_{NY}$) of a Nth point nozzle_N in the counting from the point nozzle_1 toward the point nozzle_192 can be obtained.

$$NZL_{N_X}=\{NZL_{XS}\times(257-N)+NZL_{XE}\times(N-1)\}\div 256$$

$$NZL_{N_Y}=\{NZL_{YS}\times(257-N)+NZL_{YE}\times(N-1)\}\div 256 \qquad \text{Equation 8}$$

Figure 11:
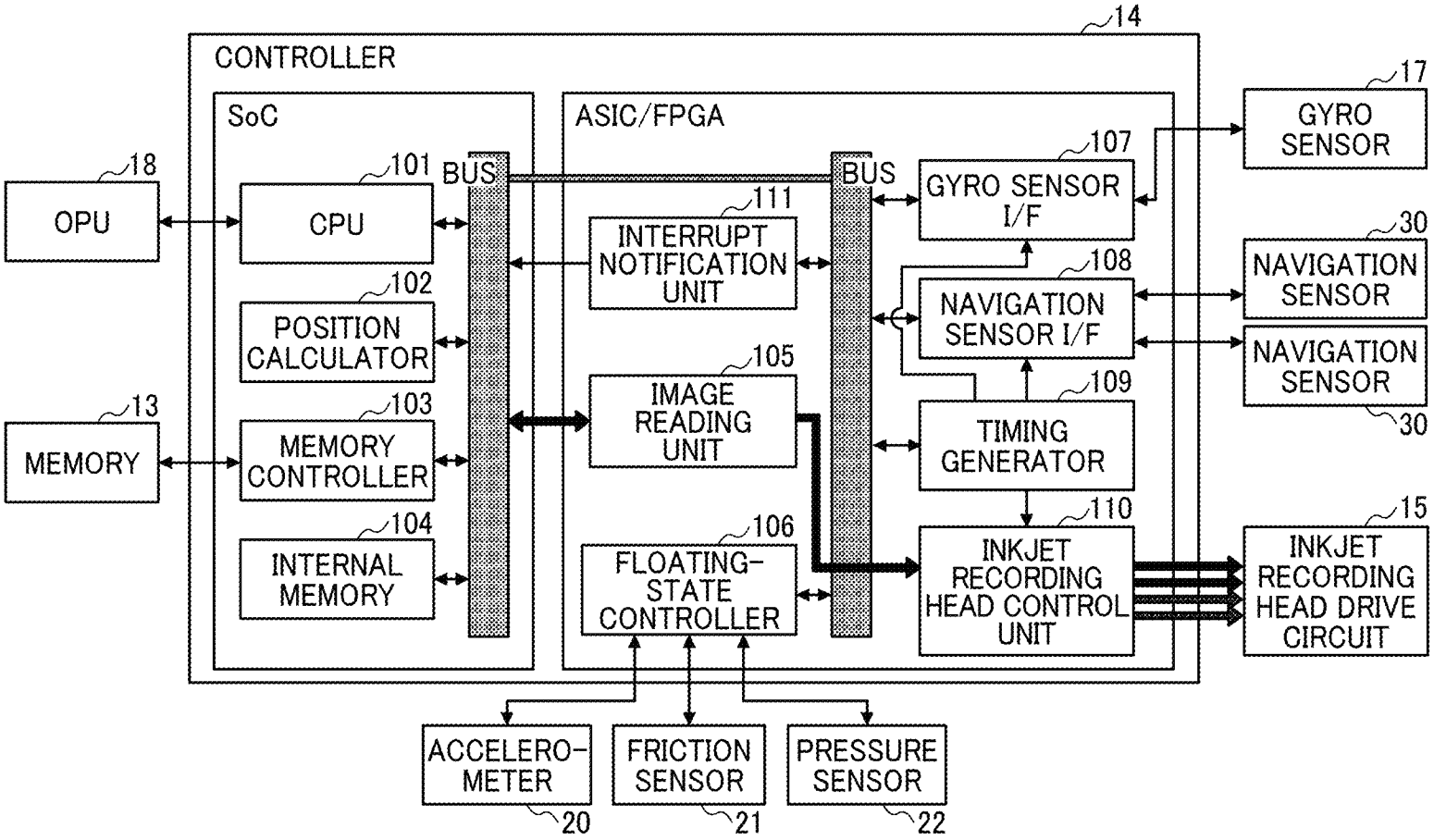
FIG. 11 is a functional block diagram of a controller of the handheld printer, according to an embodiment.

FIG. 11 is a functional block diagram of the controller 14 according to the present embodiment. As illustrated in FIG. 11, the controller 14 includes the CPU 101, a position calculator 102, a memory controller 103, an internal memory 104, an image reading unit 105, a floating-state controller 106, a gyro sensor I/F 107, a navigation sensor I/F 108, a timing generator 109 for generating printing timing and detection timing, an inkjet recording head control unit 110, and an interrupt notification unit 111. For example, as illustrated in FIG. 11, the hardware of the controller 14 (a processor) can be implemented by a system on chip (SoC) and an ASIC/FPGA that communicate with each other via a bus. The ASIC/FPGA means that the hardware can be designed to be implemented by either of ASIC and FPGA, and the hardware can be implemented by other technology than ASIC/FPGA. Further, the controller 14 can be implemented by one chip or board without using separate chips (or separate boards) respectively mounting the SoC and the ASIC/FPGA. Alternatively, the controller 14 can be implemented by three or more chips or boards. Further, each functional unit of the controller 14 can be implemented by the firmware executed by the CPU 101 or a wired logic circuit included in the SoC or the ASIC/FPGA.

The CPU 101 is a functional unit that reads and executes the firmware loaded in the memory 13 via the memory controller 103, to implement each functional unit of the controller 14.

The position calculator 102 calculates the position of the handheld printer 10, based on the movement amount and the angular speed detected for each sampling cycle of the navigation sensor 30 or the angular speed detected for each sampling cycle of the gyro sensor 17. The position of the handheld printer 10 necessary for accurate printing is, strictly speaking, the position of the nozzle. The position of the nozzle can be calculated when the position of the navigation sensor 30 is known, as described above with reference to FIGS. 7 to 10. In the present specification, the position of the navigation sensor 30 is the position of the navigation sensor 30-0 illustrated in FIG. 6 unless otherwise specified. The position calculator 102 calculates the target discharge position of ink. The position calculator 102 can be implemented by the CPU 101 executing the firmware or a wired logic circuit.

The position of the handheld printer 10 mentioned above is determined by a total movement amount obtained as an accumulation of the movement amount detected for each sampling cycle of one navigation sensor 30 and the angular speed detected for each sampling cycle of the gyro sensor 17. In other words, the amount of movement of the handheld printer 10 can be obtained with one navigation sensor 30 and one gyro sensor.

The memory controller 103 controls reading from or writing to the memory 13 from each functional unit.

The internal memory 104 is used to store information to be read and written at high speed. For example, the position information of the navigation sensor 30, the image data read from the memory 13, and the like are stored in the internal memory 104. The hardware of the internal memory 104 can be constructed with an SRAM, for example.

The image reading unit 105 calculates the position of each nozzle of the inkjet recording head 19 based on the position information of the navigation sensor 30, retrieves the image data corresponding to the nozzle position from the memory 13, and outputs the image data in the order requested by the inkjet recording head control unit 110.

Based on the acceleration acquired from the accelerometer 20, the friction coefficient acquired from the friction sensor 21, and the information acquired from the pressure sensor 22, the floating-state controller 106 determines whether the handheld printer 10 is floating and temporarily stops printing in response to a determination that the handheld printer 10 is floating (details will be described later). Alternatively, the floating-state controller 106 can determine whether the handheld printer 10 is floating based on information acquired from the navigation sensor 30 via the navigation sensor I/F 108.

The gyro sensor I/F 107 acquires the angular speed detected by the gyro sensor 17 at the timing generated by the timing generator 109 and stores the angular speed in the memory 13 or a register inside the controller 14 or the like. In a configuration where the gyro sensor 17 is not mounted on the handheld printer 10, the gyro sensor I/F 107 does not need to be included in the controller 14.

The navigation sensor I/F 108 communicates with the navigation sensor 30, receives the movement amounts ΔX and ΔY as information from the navigation sensor 30, and stores the movement amounts ΔX and ΔY in the memory 13 or the register inside the controller 14.

The timing generator 109 notifies the navigation sensor I/F 108 and the gyro sensor I/F 107 of the timings to read information from the gyro sensor 17 and the navigation sensor 30, respectively, and notifies the inkjet recording head control unit 110 of the drive timing.

The inkjet recording head control unit 110 performs dithering or the like of the image data to convert the image data into a set of points representing the image with point size and density. Through such conversion, the image data becomes data of discharge positions and point sizes. The inkjet recording head control unit 110 outputs a control signal corresponding to the point size to the inkjet recording head drive circuit 15. The inkjet recording head drive circuit 15 generates a drive waveform using the drive waveform data corresponding to the control signal. In addition, the inkjet recording head control unit 110 determines whether to discharge ink in accordance with the position of the nozzle. The inkjet recording head control unit 110 determines to discharge ink when there is a target discharge position or determines not to discharge ink when there is no target discharge position.

The interrupt notification unit 111 detects completion of communication of the navigation sensor I/F 108 with the navigation sensor 30 and outputs an interrupt signal for reporting the completion to the CPU 101. With the interruption, the CPU 101 acquires the movement amounts ΔX and ΔY stored in an internal register by the navigation sensor I/F 108. The interrupt notification unit 111 further has a function to report a status such as an error. Similarly, regarding the gyro sensor I/F 107, the interrupt notification unit 111 outputs an interrupt signal for notifying the CPU 101 of completion of communication of the gyro sensor I/F 107 with the gyro sensor 17.

Figure 12:
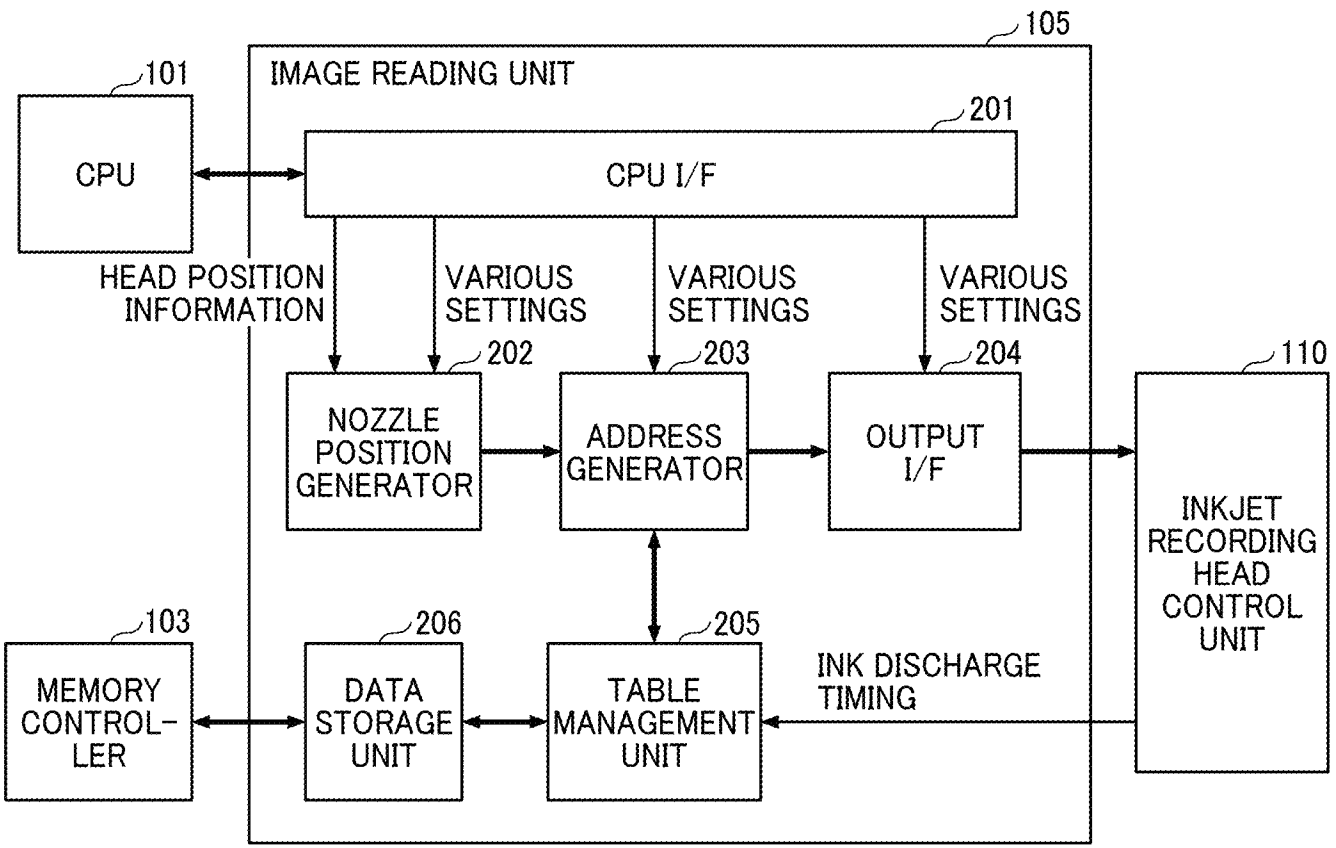
FIG. 12 is a functional block diagram illustrating an example configuration of an image reading unit according to an embodiment.

FIG. 12 is a functional block diagram illustrating an example configuration of the image reading unit 105 according to the present embodiment. The image reading unit 105 includes a CPU I/F 201, a nozzle position generator 202, an address generator 203, an output I/F 204, a table management unit 205, and a data storage unit 206.

The CPU I/F 201 acquires, from the CPU 101, various settings such as the width, the height, and the resolution of the image and applies the settings to the nozzle position generator 202, the address generator 203, or the output I/F 204. Further, the CPU I/F 201 acquires the head position information at the corresponding timing, for each ink discharge timing, from the inkjet recording head control unit 110.

The nozzle position generator 202 generates position information of each nozzle based on the head position information. Each time the nozzle position generator 202 receives the head position information, the nozzle position generator 202 generates position information for the number corresponding to the number of nozzles and outputs the position information to the address generator 203. In addition, the nozzle position generator 202 outputs a flag indicating that the nozzle is valid or invalid for each nozzle, to the address generator 203, and controls, for example, print mode and the number of discharge nozzles (limits the number of discharge nozzles).

Based on the position information of each nozzle acquired from the nozzle position generator 202, the address generator 203 generates a memory address indicating the storage location of the corresponding image data.

The output I/F 204 converts the format of the image data read out from the memory 13 into a format requested by the inkjet recording head control unit 110. Further, the output I/F 204 buffers the data as necessary.

The table management unit 205 associates the address generated by the address generator 203 with the data stored in the data storage unit 206. The data storage unit 206 accumulates the data read from the memory 13 via the memory controller 103. Further, the data storage unit 206 temporarily accumulates the data to be written in the memory 13.

Figure 13A:
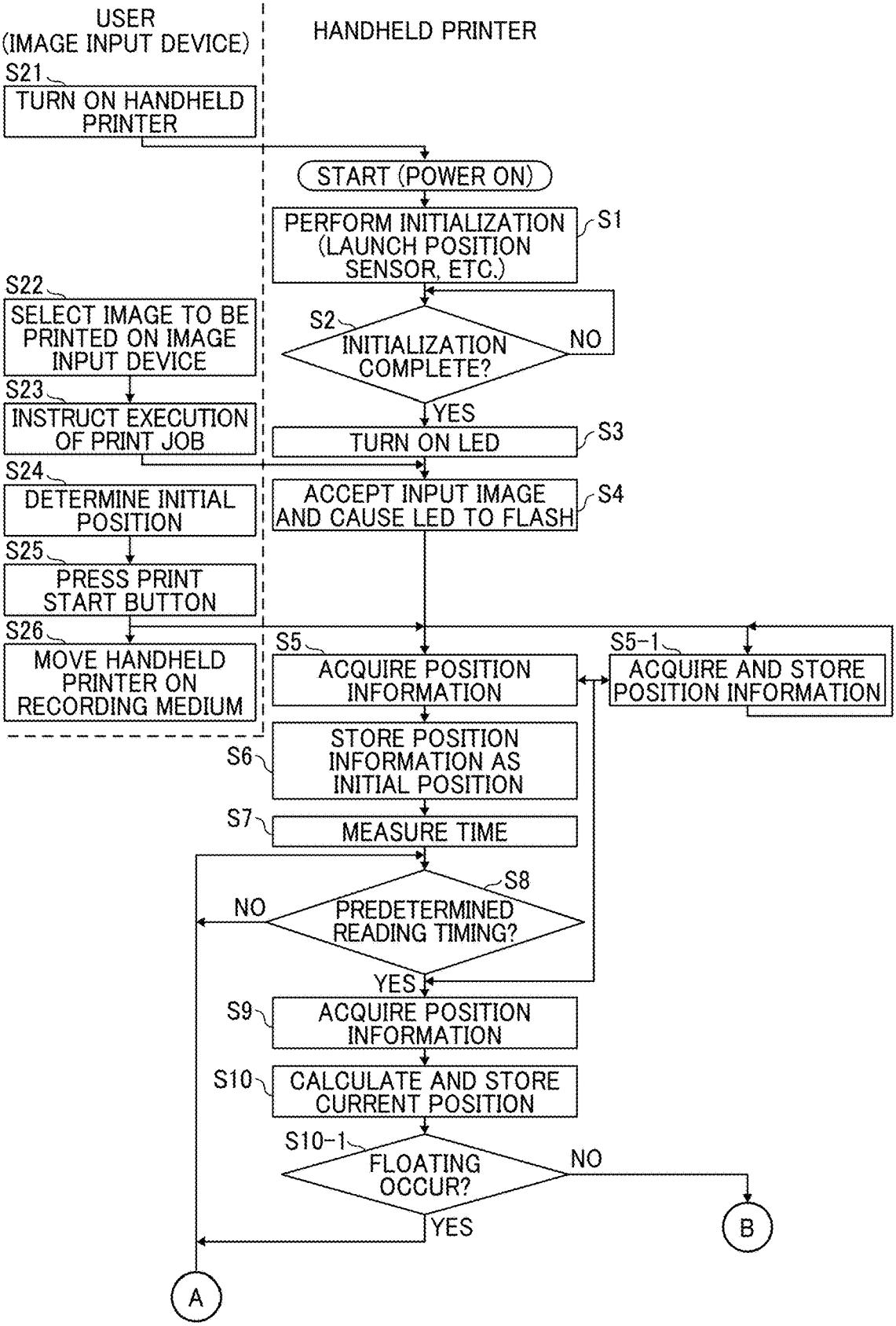
FIG. 13 is divided to FIGS. 13A and 13B and illustrates a flowchart illustrating an example of printing processing including float determination according to an embodiment.
Figure 13B:
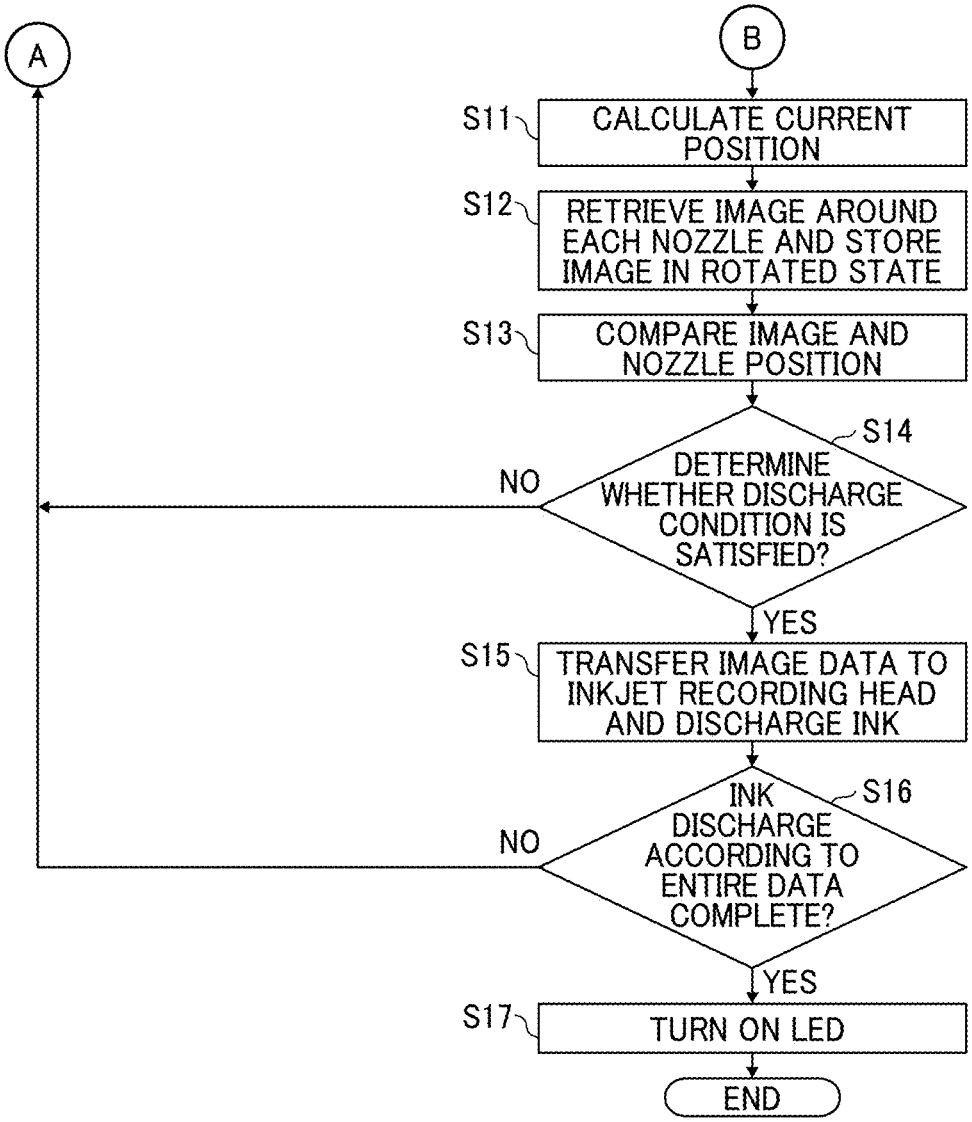

FIGS. 13A and 13B illustrate a flowchart of an example procedure including a floating determination and stopping ink discharge during printing, according to the present embodiment.

At S21, according to an operation made by a user, the image input device 100 turns on the handheld printer 10, and the handheld printer 10 starts operation. Subsequently, the handheld printer 10 is supplied with power from a power source, and the controller 14 performs initialization of the devices such as a position sensor and launches the devices (S1). At S2, the handheld printer 10 determines whether the initialization has completed. In response to completion of the initialization (Yes at S2), for example, the handheld printer 10 turns on the LED as a notification for the user of a printable state (S3). The user confirms the notification and selects an image to be printed by the image input device 100, such as a smart device or a PC (S22). Subsequently, the user instructs execution of a print job, such as wireless output of data in the format of TIFF (Tagged Image File Format), JPEG (Joint Photographic Experts Group), or the like, from an application or a printer driver installed in the image input device 100 (S23). In response to input of the image data, the handheld printer 10 notifies the user of the acceptance with, for example, blinking of the LED or the like (S4).

At S24, the user determines the initial position of the handheld printer 10 on a recording medium, such as a notebook, and presses a print start button of the handheld printer 10 at S25. At S26, the user freely moves the handheld printer 10 (freehand scanning) on the plane on the recording medium to form an image (S26).

While the user performs operations at S25 and S26, the handheld printer 10 receives pressing of the print start button and instructs the navigation sensor I/F 108 to read the position information of the navigation sensor 30. Subsequently, the navigation sensor 30 starts detecting the movement amount and stores the position information in the internal memory 104 of the controller 14 (S5-1). The navigation sensor I/F 108 communicates with the navigation sensor 30 and reads the position information (S5). Subsequently, the handheld printer 10 sets the position defined by the position information as an initial position and sets the coordinates, for example, to coordinate (0, 0) at S6.

At S7, the timing generator 109 in the controller 14 measures time, for example, with a counter. At S8, the controller 14 determines whether the time matches a predetermined timing for reading the position information generated by the navigation sensor 30, which is equivalent to each drive period of the inkjet recording head control unit 110. Each time the reading timing arrives (Yes at S8), at S9, the controller 14 repeats acquisition of the position information. At S10, based on the previously calculated coordinates (X, Y) of the navigation sensor 30 and the movement amount ($\Delta X$, $\Delta Y$) based on the currently acquired position information, the controller 14 calculates the current coordinates of the navigation sensor 30 using the method described with reference to FIGS. 6 and 7 and stores the current coordinates in the internal memory 104 of the controller 14.

At S10-1, the floating-state controller 106 determines whether or not the handheld printer 10 is floating based on the information acquired from the navigation sensor 30.

Figure 14B:
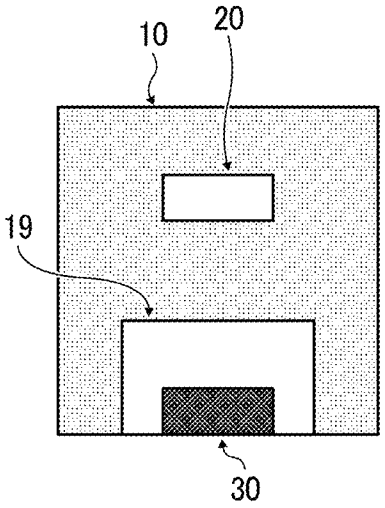
FIGS. 14A and 14B are respectively a front view and a side view of the handheld printer, for explaining a method for determining floating by the navigation sensor according to an embodiment.
Figure 14A:
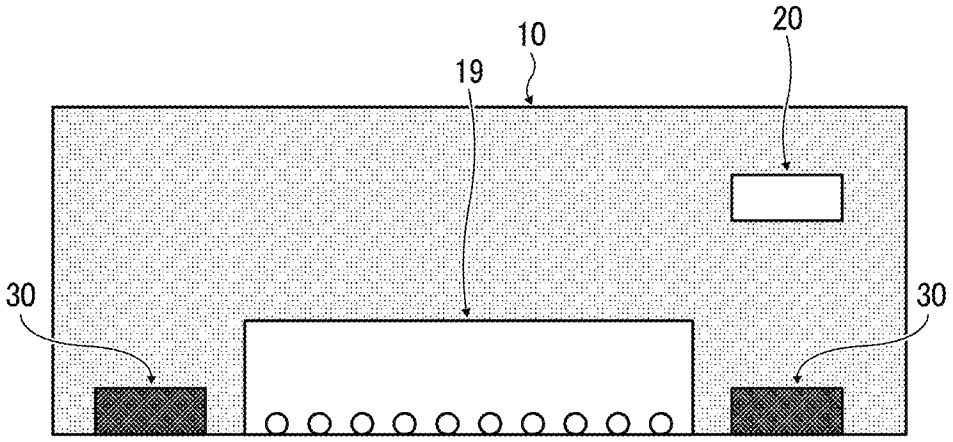

FIGS. 14A and 14B are respectively a front view and a side view of the handheld printer 10, for explaining a method for determining floating of the handheld printer 10, by the navigation sensor 30.

As illustrated in the front view of the handheld printer 10 illustrated in FIG. 14A, one navigation sensor 30 is disposed at each end of the inkjet recording head 19. The handheld printer 10 further includes the accelerometer 20. In the side view of the handheld printer 10 illustrated in FIG. 14B, the accelerometer 20 and the navigation sensor 30 are located approximately at a center of the handheld printer 10.

Figure 15A:
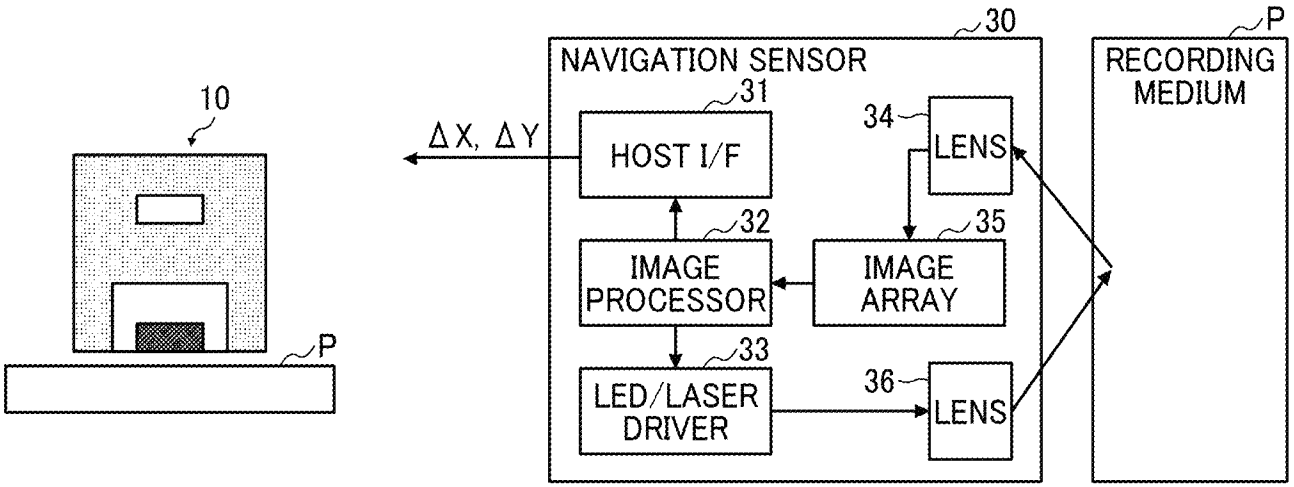
FIGS. 15A and 15B are diagrams for explaining a method for determining floating by the navigation sensor according to an embodiment.
Figure 15B:
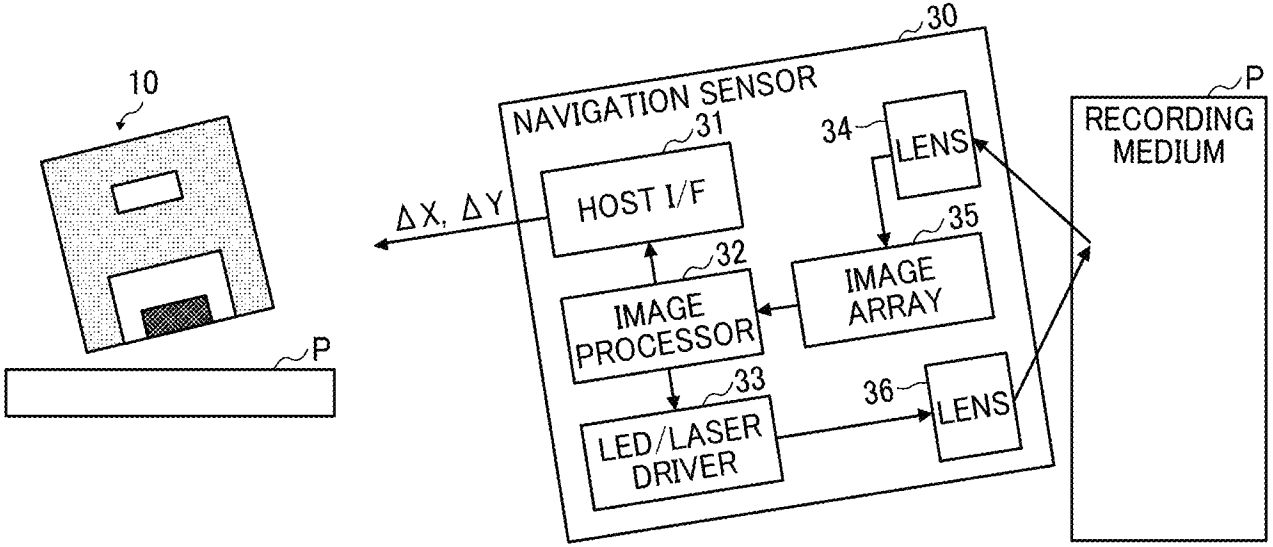

FIGS. 15A and 15B are diagrams for explaining a method for determining floating of the handheld printer 10 by the navigation sensor 30.

In a state illustrated in FIG. 15A where the handheld printer 10 is not floating, the navigation sensor 30 irradiates the recording medium P with light from the LED and calculates the movement amount with the amount of received light reflected from the recording medium P. The handheld printer 10 and the recording medium P are in substantially parallel contact.

FIG. 15A illustrates a state where the handheld printer 10 is floating. If the handheld printer 10 floats from the recording medium P, even if the navigation sensor 30 irradiates the recording medium P with light from the LED, the navigation sensor 30 does not receive the light reflected from the recording medium P. The floating-state controller 106 acquires, from the navigation sensor 30, information indicating that the navigation sensor 30 does not receive the light, thereby detecting the floating. While the handheld printer 10 floats from the recording medium P, the handheld printer 10 is not in close contact with the recording medium P. For example, the handheld printer 10 tilts in either direction, and a clearance is present between the handheld printer 10 and the recording medium P.

Referring back to FIG. 13A, in S10-1, when the floating-state controller 106 determines that floating has occurred, the process proceeds to S8, and the controller 14 controls the inkjet recording head drive circuit 15 not to discharge ink (Yes in S10-1). When the floating-state controller 106 determines that the handheld printer 10 is not floating, the process proceeds to S11 and ink discharge is performed (No in S10-1).

In S11, based on the calculated current position information of each navigation sensor 30 and predetermined assembling position information of the navigation sensor 30 and the inkjet recording head 19, the controller 14 calculates coordinates of the position of each nozzle on the inkjet recording head 19.

At S12, based on the position information of each nozzle calculated in S11, the image reading unit 105 reads the image data of the inkjet recording head 19 or image data around each nozzle from the memory 13. The image reading unit 105 rotates the image according to the position and inclination of the inkjet recording head 19, specified by the position information, and stores the rotated image in the internal memory 104. At S13, the image reading unit 105 performs coordinate comparison between the image data stored in the internal memory 104 and each nozzle position and determines whether a predetermined discharge condition is satisfied at S14. In response to a determination that the predetermined discharge condition is satisfied (Yes in S14), the image reading unit 105 outputs the image data to the inkjet recording head control unit 110 (S15). The predetermined discharge condition is a tolerable misalignment between an image and a nozzle, which can be determined empirically and stored in a memory by a manufacturer, for example. When the misalignment is smaller than the tolerable misalignment, ink is discharged. By contrast, in response to a determination that the predetermined discharge condition is not satisfied (No in S14), the process returns to S8.

The handheld printer 10 repeats the operation from S8 to S15 to form an image on the recording medium P. At S16, the handheld printer 10 determines whether ink discharge according to entire image data has completed. When ink discharge according to entire image data has completed (Yes in S16), the handheld printer 10 notifies the user of completion of printing with, for example, LED lighting at S17. By contrast, in response to a determination that there remains data according to which ink discharge is not yet performed, (No in S16), the process returns to S8.

When the user determines that sufficient ink discharge has been performed, the user can press a print completion button to complete the printing, even when ink discharge has not yet completed for the entire data.

Figure 16A:
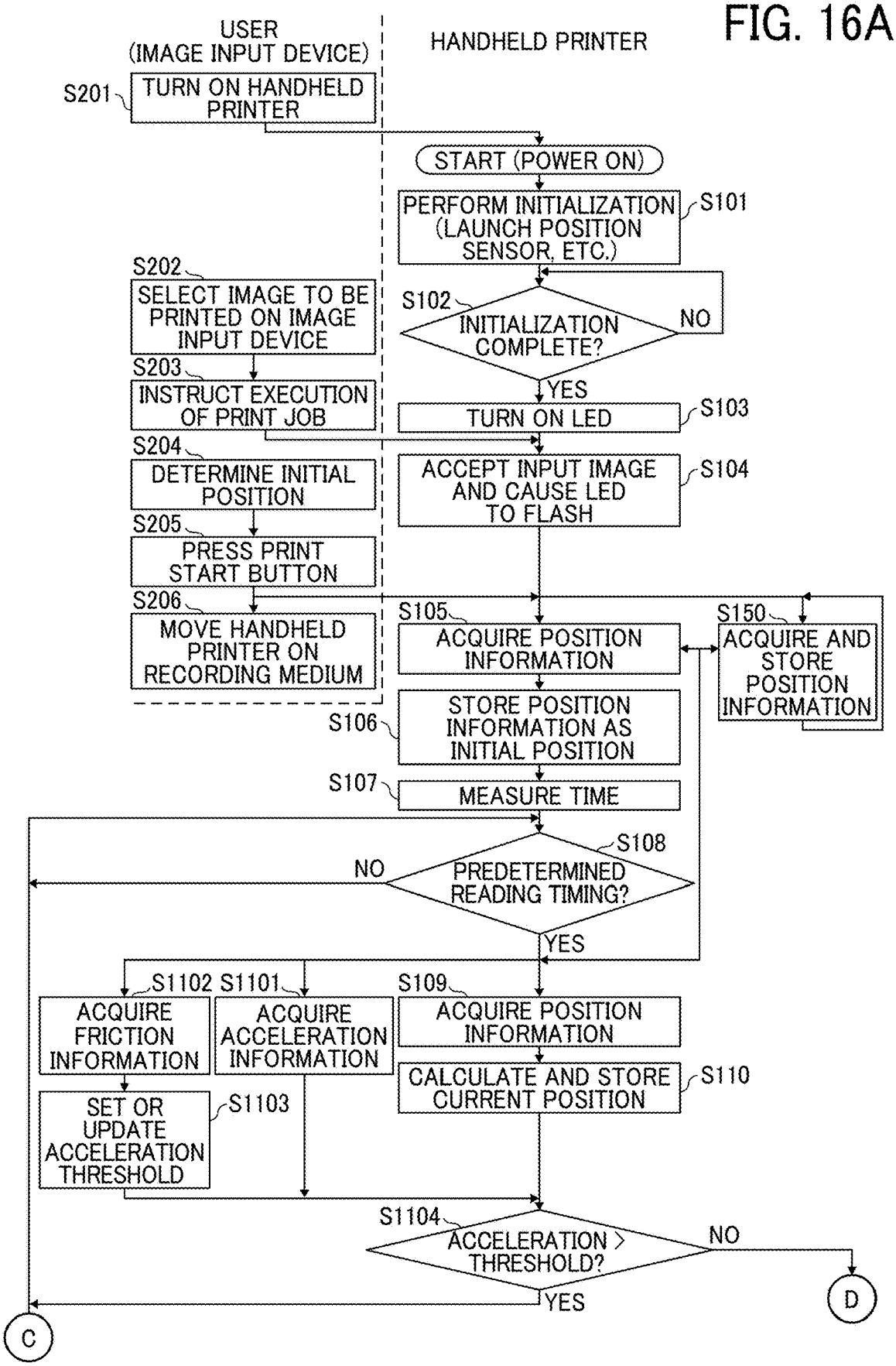
FIG. 16 is divided into FIGS. 16A and 16B and illustrates a flowchart for explaining stopping ink discharge in response to the determination of floating based on the acceleration and the friction coefficient according to an embodiment.
Figure 16B:
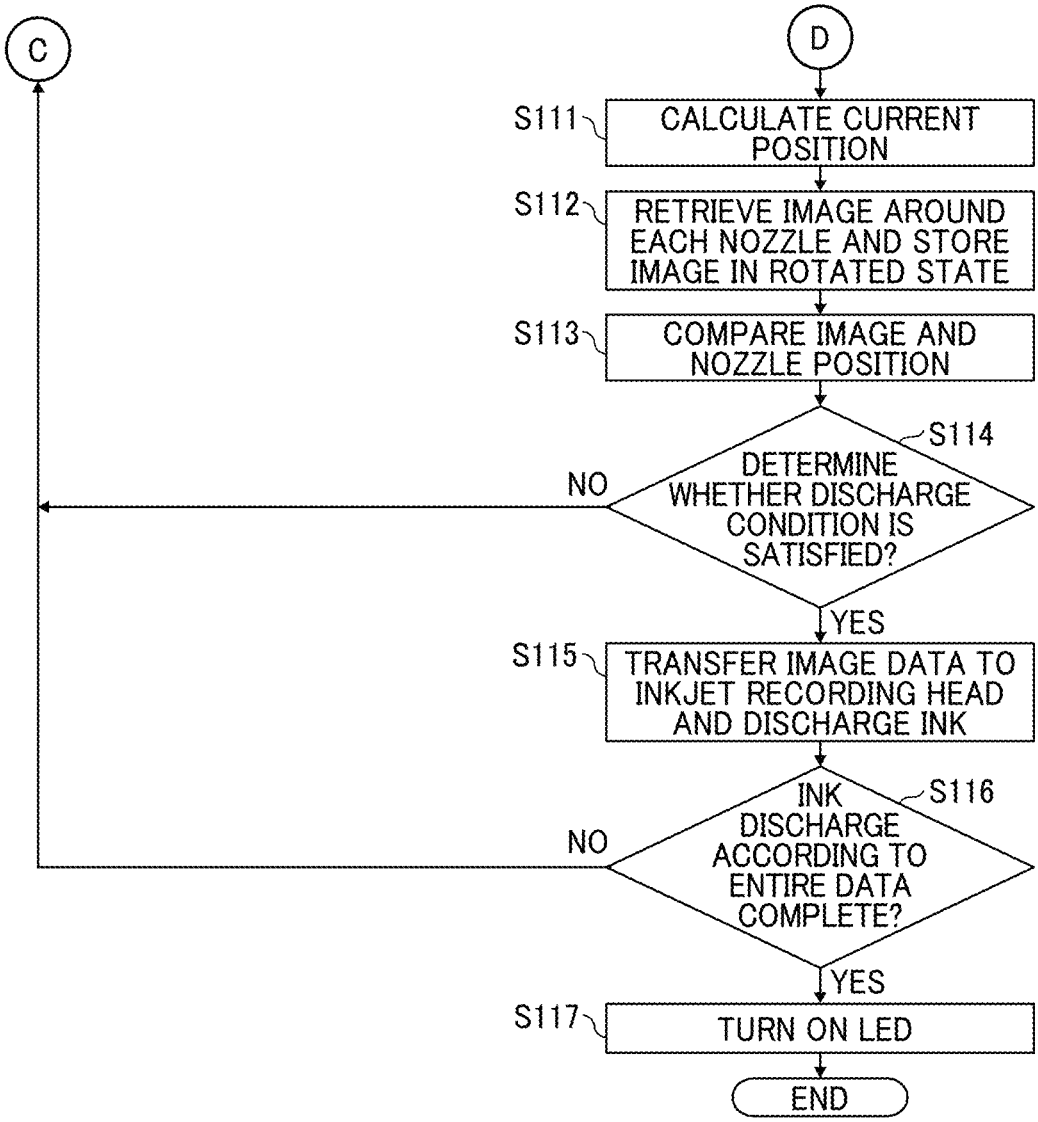

FIGS. 16A and 16B illustrate a flowchart for explaining stopping ink discharge in response to the determination of floating based on the acceleration and the friction coefficient according to the present embodiment. Steps different from the steps in the flowchart of FIGS. 13A and 13B will be described.

In FIGS. 16A and 16B, operations from S201 to S206, and operations from S101 to S108 are respectively similar to the operations from S21 to S26 and the operations S1 to S8 in FIG. 13A. S150 is similar to S5-1 in FIG. 13A.

In S1101 executed in parallel to S109 and S110, the floating-state controller 106 acquires acceleration information from the accelerometer 20. In S1102, the floating-state controller 106 acquires friction information from the friction sensor 21.

Figure 17:
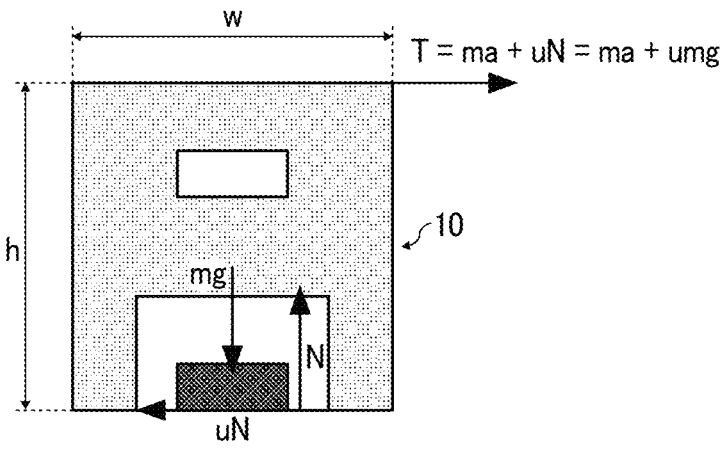
FIG. 17 is a diagram for explaining a method for determining the floating based on the acceleration and the friction coefficient of the recording medium according to an embodiment.

FIG. 17 is a diagram for explaining a method for determining the floating based on the acceleration and the friction coefficient of the recording medium P according to the present embodiment.

Assume that the handheld printer 10 has a height h, a width w, and a weight m and the handheld printer 10 is moved with force T. In this case, from the moment of force applied to the handheld printer 10, the following equation representing a condition to cause floating is derived.

$$T \times h > mg \times w/2$$

$$(ma+uN) \times h > mg \times w/2$$

$$(ma+umg) \times h > mg \times w/2$$

$$a > g \times (w-2uh)/2h$$

where a is the acceleration, u is a dynamic friction coefficient of the recording medium P, g is a gravitational acceleration, and N is a normal force (normal reaction).

Accordingly, when the acceleration a ($m/s^2$) exceeds a threshold expressed as g×(w−2uh)/2h, the handheld printer 10 floats. Regarding the threshold "g×(w−2uh)/2h", the gravity acceleration g is a known physical quantity (9.80665 ($m/s^2$), and the width w and the height h are known from the specifications of the handheld printer 10. Therefore, as the dynamic friction coefficient u of the recording medium P is calculated, the acceleration a ($m/s^2$) at which floating occurs is obtained. The method of calculating the dynamic friction coefficient u of the recording medium P will be described later.

The acceleration a ($m/s^2$) (=g×(w−2uh)/2h) at which the occurrence of floating is predicted is set as a floating determination threshold. Then, ink discharge can be stopped when the floating occurs.

Further, the regarding floating determination threshold, providing a margin to the acceleration a ($m/s^2$) (=g×(w−2uh)/2h) at which floating occurs, that is, setting the floating determination threshold to a smaller acceleration value is advantageous in that ink discharging can be stopped before the floating occurs.

The acceleration a ($m/s^2$) can be either of during acceleration (a>0) or deceleration (a<0). Note that, since the acceleration a is smaller than 0 during deceleration, the condition to cause floating expressed as a>g×(w−2uh)/2h is not satisfied during deceleration. Accordingly, floating due to friction does not occur.

Note that, assuming that the static friction coefficient $u_0$, a condition to cause the floating in a stop state (when the acceleration a=0) is expressed as:

$$u_0 mg \times h > mg \times w/2$$

$$u_0 > w/2h.$$

Accordingly, the condition to cause the floating is determined by the height h (the height at which the user applies the force T), the width w, and the coefficient of static friction $u_0$. That is, depending on the structure or specification of the handheld printer 10, the conditions under which the floating occurs is determined. Therefore, whether or not the floating due to friction occurs in the stopped state does not depend on the force applied by the user while the use moves the handheld printer 10.

Figure 18:
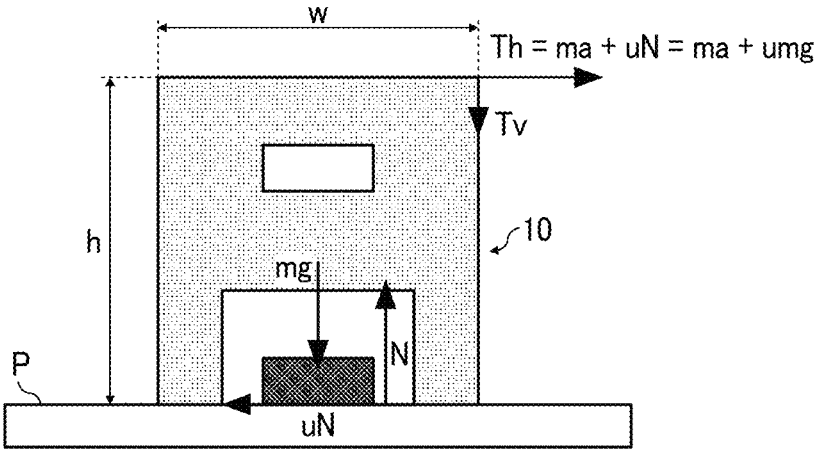
FIG. 18 is a side view for explaining a method of determining floating based on a force pressing the handheld printer against the recording medium according to an embodiment.

FIG. 18 is a side view for explaining a method of determining floating based on a force pressing the handheld printer 10 against the recording medium P according to the present embodiment.

When the handheld printer 10 having the height h, the width w, and the weight m is moved with a force Th in the scanning direction and pressed against the recording medium P with a force Tv, the following equation is derived as a condition to cause the floating, from the moment of force applied to the handheld printer 10.

$$Th \times h > mg \times w/2 + Tv \times h$$

$$(ma+uN) \times h > mg \times w/2 + Tv \times h$$

$$(ma+umg) \times h > mg \times w/2 + Tv \times h$$

$$a > g \times (w-2uh)/2h + Tv/m$$

where a is the acceleration, u is the dynamic friction coefficient of the recording medium P, g is a gravitational acceleration, and N is the normal force.

Accordingly, when the acceleration a ($m/s^2$) exceeds a threshold expressed as g×(w−2uh)/2h+Tv/m, the handheld printer 10 floats. That is, even when the acceleration increases by "Tv/m", the floating is less likely to occur as compared with the case where the pressing force Tv illustrated in FIG. 17 is not present.

Figure 19A:
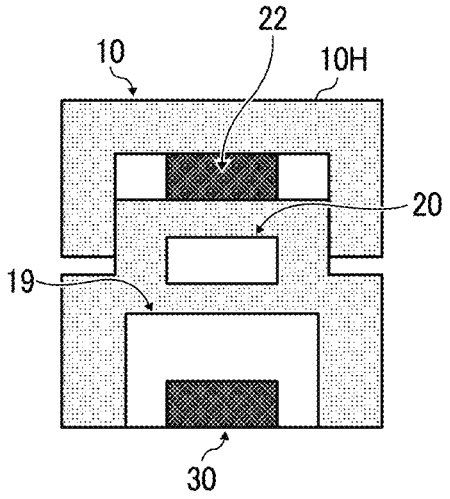
FIGS. 19A and 19B are side views for explaining a method of measuring, with the pressure sensor, the force pressing the handheld printer against the recording medium according to an embodiment.
Figure 19B:
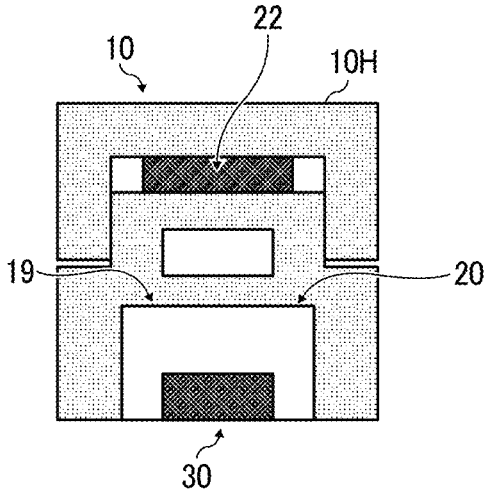

FIGS. 19A and 19B are side views for explaining a method of measuring, with the pressure sensor 22, the force pressing the handheld printer 10 against the recording medium P according to the present embodiment. In FIG. 19A, a pressing force is not applied to the handheld printer 10. In FIG. 19B, a pressing force is not applied to the handheld printer 10.

As illustrated in FIGS. 19A and 19B, the pressure sensor 22 is mounted on a housing 10H of the handheld printer 10, and the force pressing the recording medium P is measured. When a strain gauge is used as the pressure sensor 22, a resistance value changes in accordance with the pressure applied to the sensor. The change in the resistance value is changed into an electric signal and transmitted to the floating-state controller 106, to detect the pressing force. Therefore, with the housing 10H illustrated in FIGS. 19A and 19B, in which the force of the user pressing the handheld printer 10 is applied to the pressure sensor 22, the pressing force can be measured with the pressure sensor 22.

Figure 20:
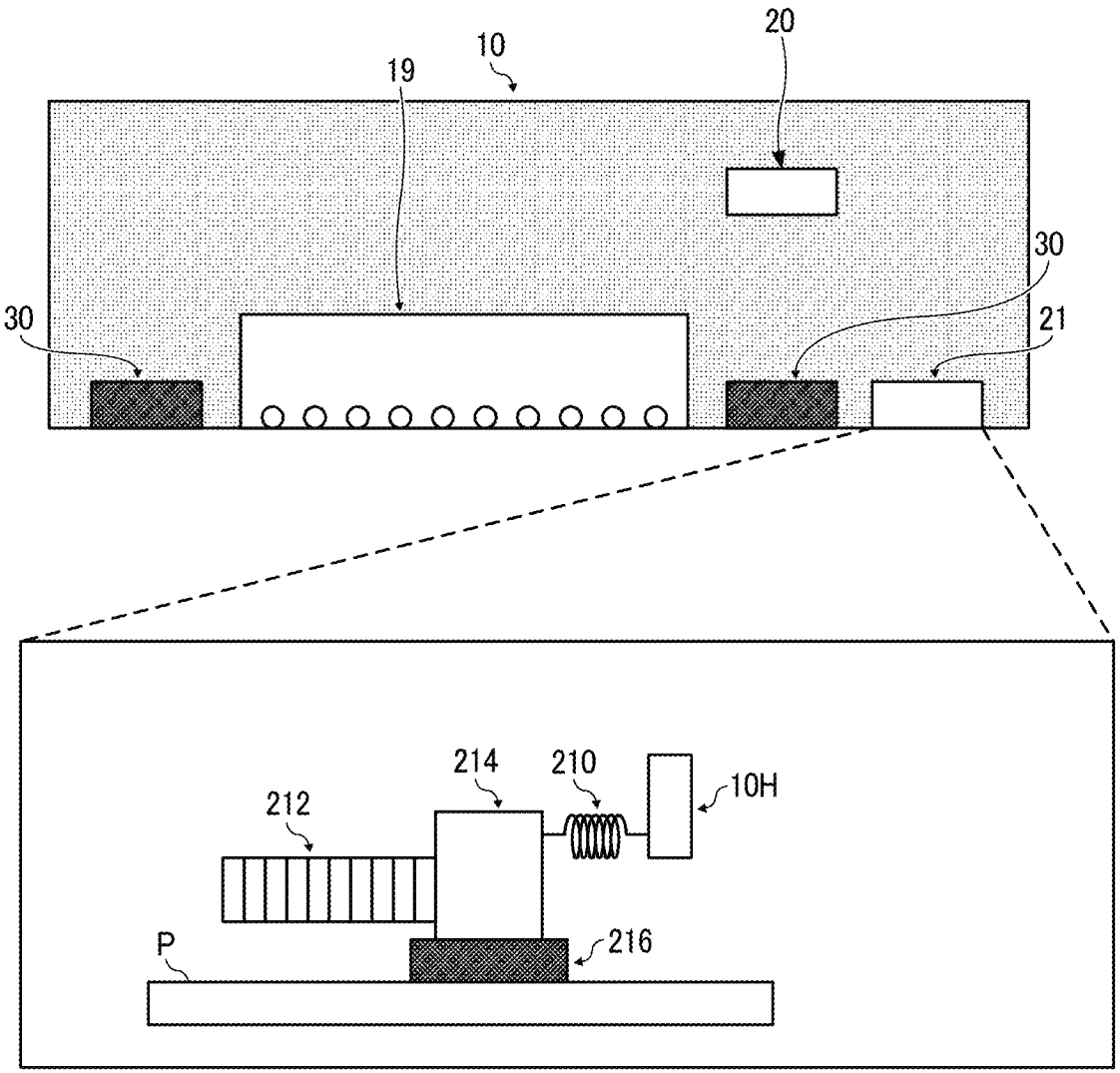
FIG. 20 is a diagram for explaining a method of calculating the friction coefficient of the recording medium according to an embodiment.

FIG. 20 is a diagram for explaining a method of calculating the friction coefficient of the recording medium P in the present embodiment.

As illustrated in the front view of the handheld printer 10 illustrated in FIG. 20, one navigation sensor 30 is disposed at or adjacent to each end of the inkjet recording head 19. Further, the handheld printer 10 includes the accelerometer 20 and the friction sensor 21. As illustrated in the enlarged view of the friction sensor 21 in FIG. 20, the friction sensor 21 includes a spring 210, a linear scale 212, a linear encoder sensor 214, and a contact portion 216 to contact the recording medium P. The spring 210 is coupled to the housing 10H of the handheld printer 10 and the linear encoder sensor 214 to expand or contract according to the frictional force generated between the recording medium P and the contact portion 216. The amount of expansion and contraction of the spring 210 is measured by the linear scale 212 and the linear encoder sensor 214, and the dynamic friction coefficient is calculated based on the measurement.

Figure 21A:
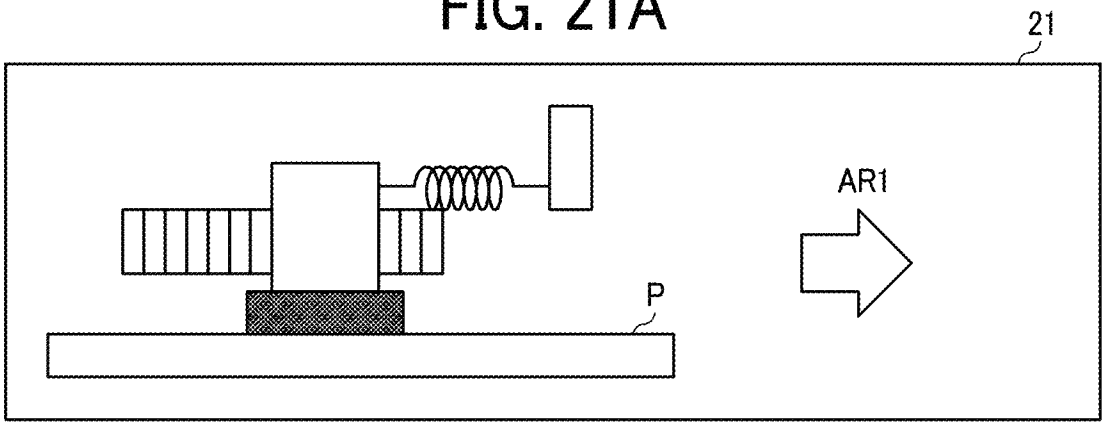
FIGS. 21A and 21B are diagrams for explaining the method of calculating the friction coefficient of the recording medium according to an embodiment.
Figure 21B:
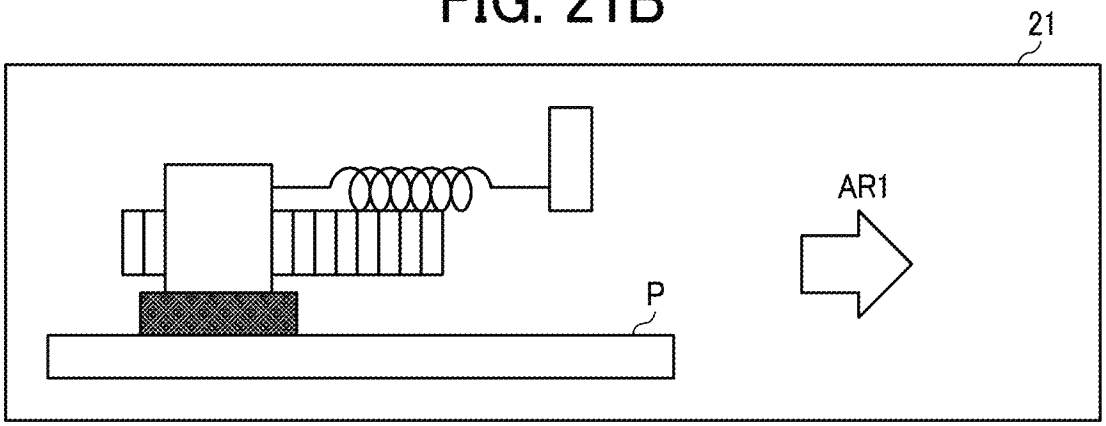

FIGS. 21A and 21B are diagrams for explaining the method of calculating the friction coefficient of the recording medium P in the present embodiment.

FIGS. 21A and 21B illustrate an example in which a linear encoder is used for friction detection. When the contact portion 216 (see FIG. 20) is not in contact with the recording medium P, the linear encoder sensor 214 is secured at a home position by the pulling force of the spring 210. In FIGS. 21A and 21B, the home position is the right end on the linear scale 212, and arrow AR1 indicates the direction of movement of the handheld printer 10.

As the handheld printer 10 is moved with the contact portion 216 in contact with the recording medium P, the linear encoder sensor 214 moves to a position where the frictional force and the tensile force of the spring 210 are in equilibrium. Since the pulling force of the spring 210 is known, the dynamic friction coefficient can be calculated from the position information of the linear encoder sensor 214.

FIG. 21A illustrates a case of a recording medium with a low friction coefficient. As illustrated in FIG. 21A, in the case of the recording medium having a small dynamic friction coefficient, the frictional force and the tensile force of the spring 210 are balanced in a state where the expansion of the spring 210 in the direction indicated by arrow AR1, in which the handheld printer 10 moves, is relatively small. FIG. 21B illustrates a case of a recording medium with a large friction coefficient. As illustrated in FIG. 21B, in the case of the recording medium having a large dynamic friction coefficient, the frictional force and the tensile force of the spring 210 are balanced in a state where the expansion of the spring 210 in the direction indicated by arrow AR1, in which the handheld printer 10 moves, is relatively large.

Referring back to FIGS. 16A and 16B, in S1103, the floating-state controller 106 calculates the dynamic friction coefficient based on the friction information acquired in S1102. Subsequently, based on the dynamic friction coefficient, the floating-state controller 106 sets or updates the acceleration threshold for determining the floating according to the method for determining the floating illustrated in FIG. 17 or FIG. 18. The method for determining the floating is not limited to the method illustrated in FIG. 17 or FIG. 18, but other methods may be used. In S1104, the floating-state controller 106 compares the acceleration acquired in S1101 with the acceleration threshold set or updated in S1103. In response to a comparison result that the acceleration is larger than the threshold, the floating-state controller 106 determines that floating has occurred, and, at S108, the controller 14 controls the inkjet recording head drive circuit 15 not to discharge ink (Yes in S1104). By contrast, when the floating-state controller 106 determines that the handheld printer 10 is not floating, at S111, the controller 14 controls the inkjet recording head drive circuit 15 to discharge ink (No in S1104). The operation after S111 is similar to the operation illustrated in FIGS. 13A and 13B.

Figure 22A:
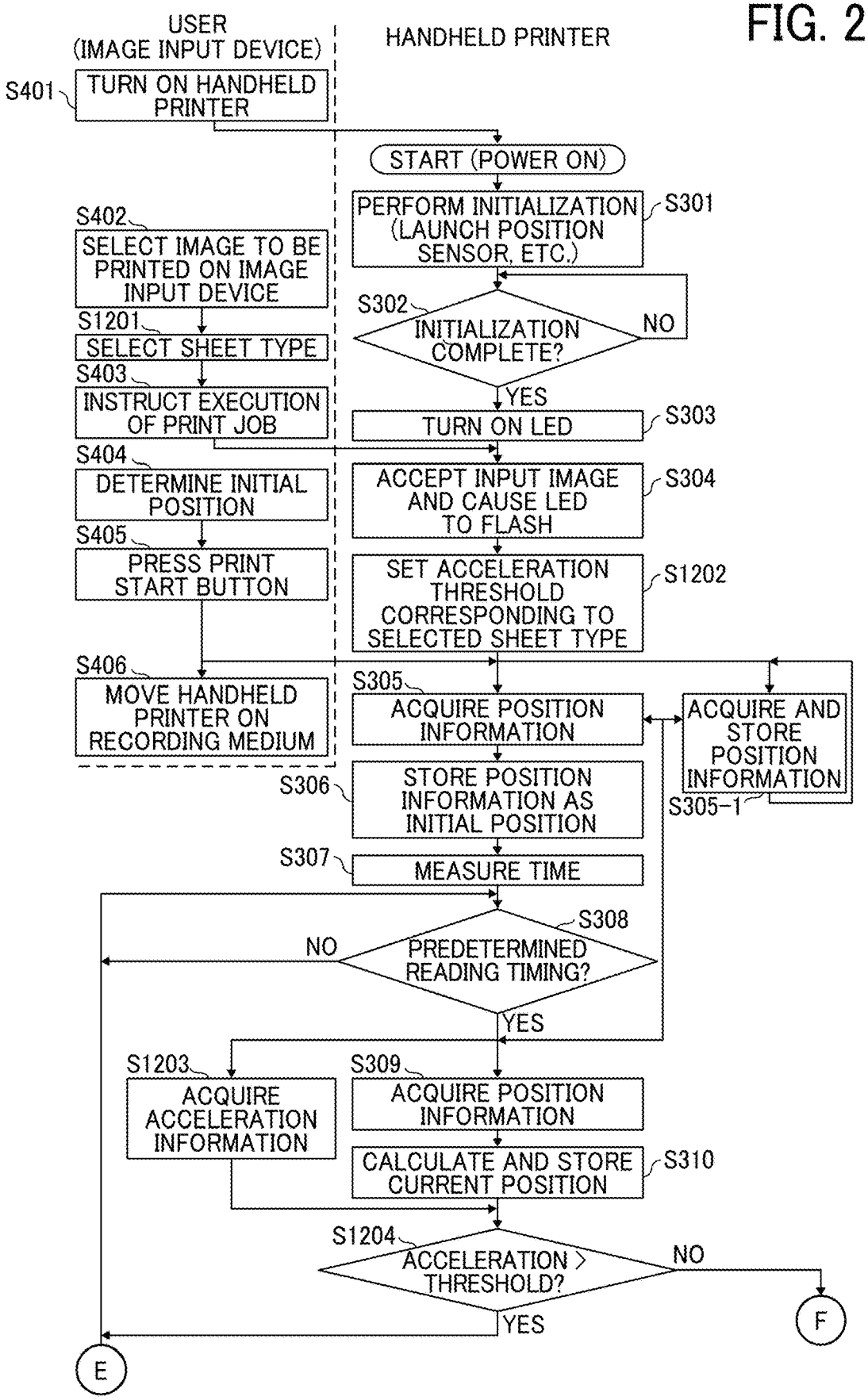
FIG. 22 is divided into FIGS. 22A and 22B and illustrates a flowchart of control operation to stop ink discharge in response to the floating determination in which the friction coefficient is designated in advance, according to an embodiment.
Figure 22B:
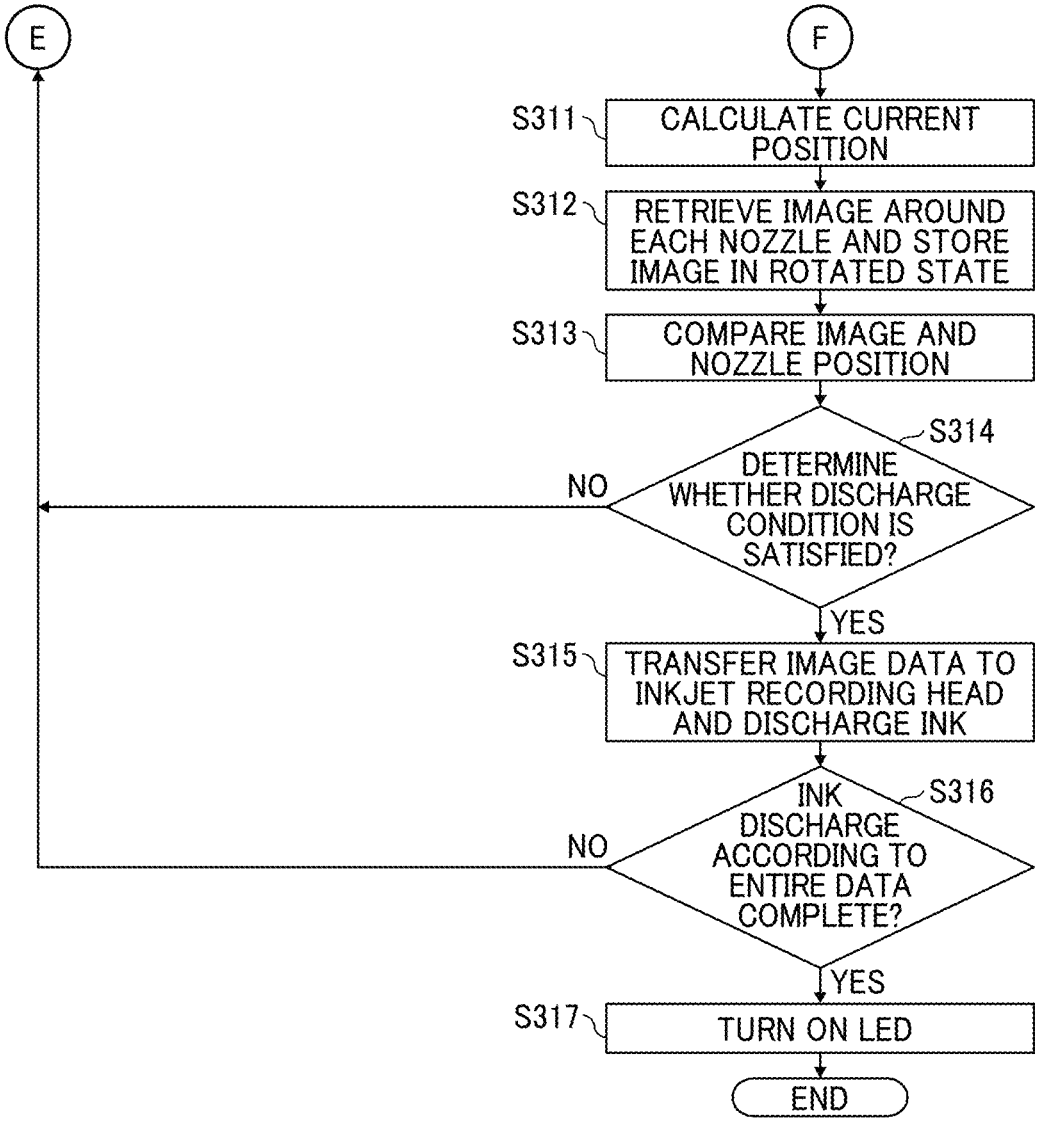

FIGS. 22A and 22B illustrate a flowchart of control operation to stop ink discharge in response to the floating determination in which the friction coefficient is designated in advance, according to the present embodiment. Steps different from the steps in the flowchart of FIG. 13 will be described.

In FIG. 22, the operation from S401 to S402 is similar to the operation from S21 to S26 in FIG. 13A. In S1201 executed following S402, the user performs print setting for the handheld printer 10, selects the type of recording medium P, and proceeds to S403. The operation from S403 to S406 is similar to the operation from S23 to S26 in FIG. 13A.

The operation from S301 to S304 is similar to the operation from S1 to S4 in FIG. 13A. In S1202 following S304, the floating-state controller 106 uses the dynamic friction coefficient corresponding to the type of recording medium P selected in S1201, to set the acceleration threshold in the same manner as in S1103 illustrated in FIGS. 16A and 16B.

FIG. 23 is a table illustrating friction coefficients designated to sheet types for the method of selecting the recording medium type to designate the friction coefficient in the present embodiment. As illustrated in FIG. 23, dynamic friction coefficients corresponding to types of the recording medium P are defined. When the user selects, for example, "paper (high friction)", a dynamic friction coefficient of 0.7 is designated. The floating-state controller 106 uses the dynamic friction coefficient of 0.7 to set the acceleration threshold. Further, when the user selects "aluminum", for example, a dynamic friction coefficient of 0.8 is designated. The floating-state controller 106 sets the acceleration threshold using the dynamic friction coefficient of 0.8.

The operation from S305 to S308 is similar to the operation from S5 to S8 in FIG. 13A. S305-1 is similar to S5-1 in FIG. 13A.

In S1203 executed in parallel with S309 and S310, the floating-state controller 106 acquires the acceleration information from the accelerometer 20. In S1204, the floating-state controller 106 compares the acceleration acquired in S1203 with the acceleration threshold set in S1202. When the acceleration is higher than the threshold (Yes in S1204, the floating-state controller 106 determines that the floating has occurred. Then the process proceeds to S308, and ink discharge is not performed. When the floating-state controller 106 determines that the handheld printer is not floating (No in S1204), the process proceeds to S311 to perform ink discharge. The operation after S311 is similar to the operation illustrated in FIGS. 13A and 13B.

Figure 24A:
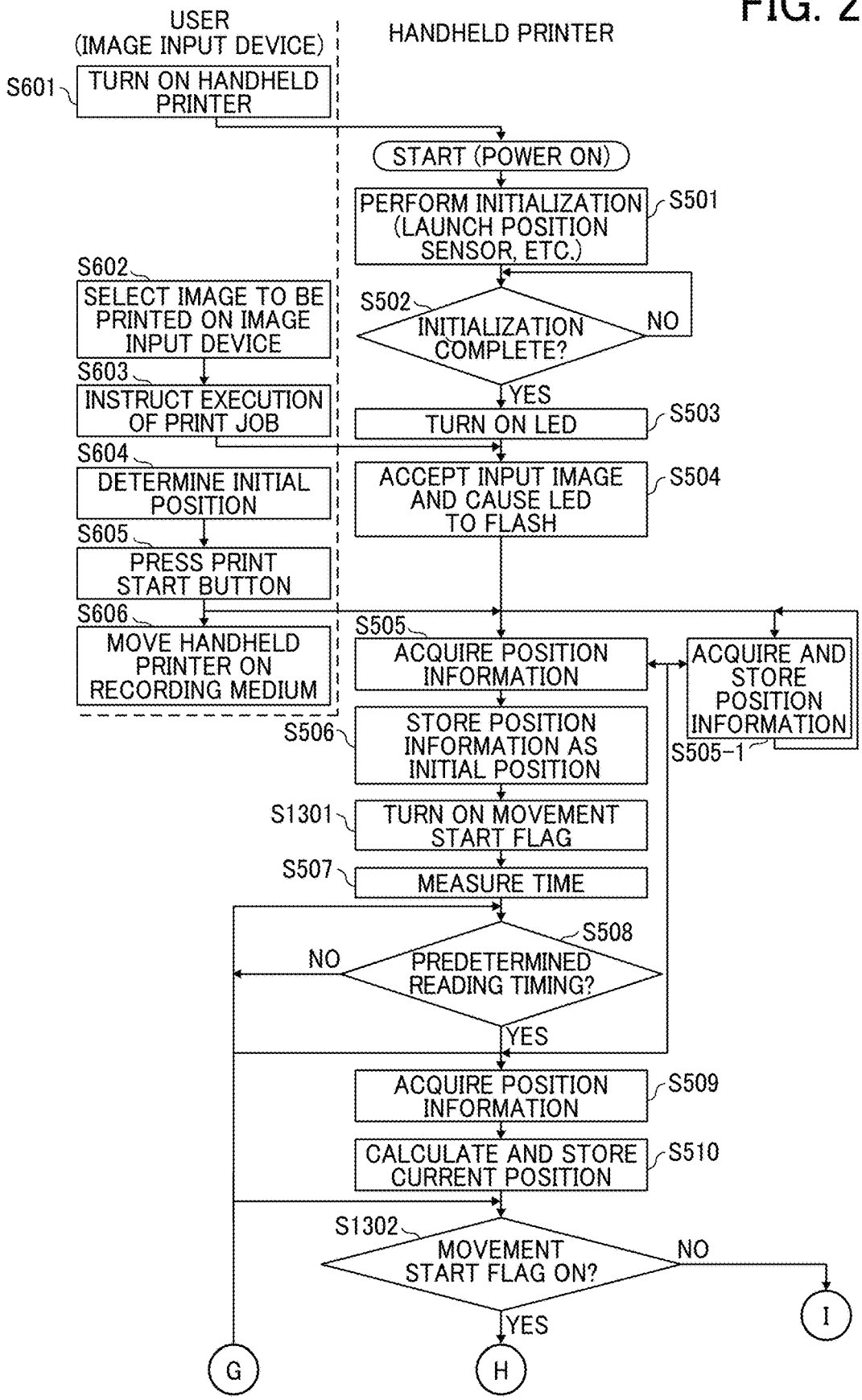
FIG. 24 is divided into FIGS. 24A and 24B and illustrates a flowchart for explaining stopping ink discharge at the start of printing according to the present embodiment.
Figure 24B:
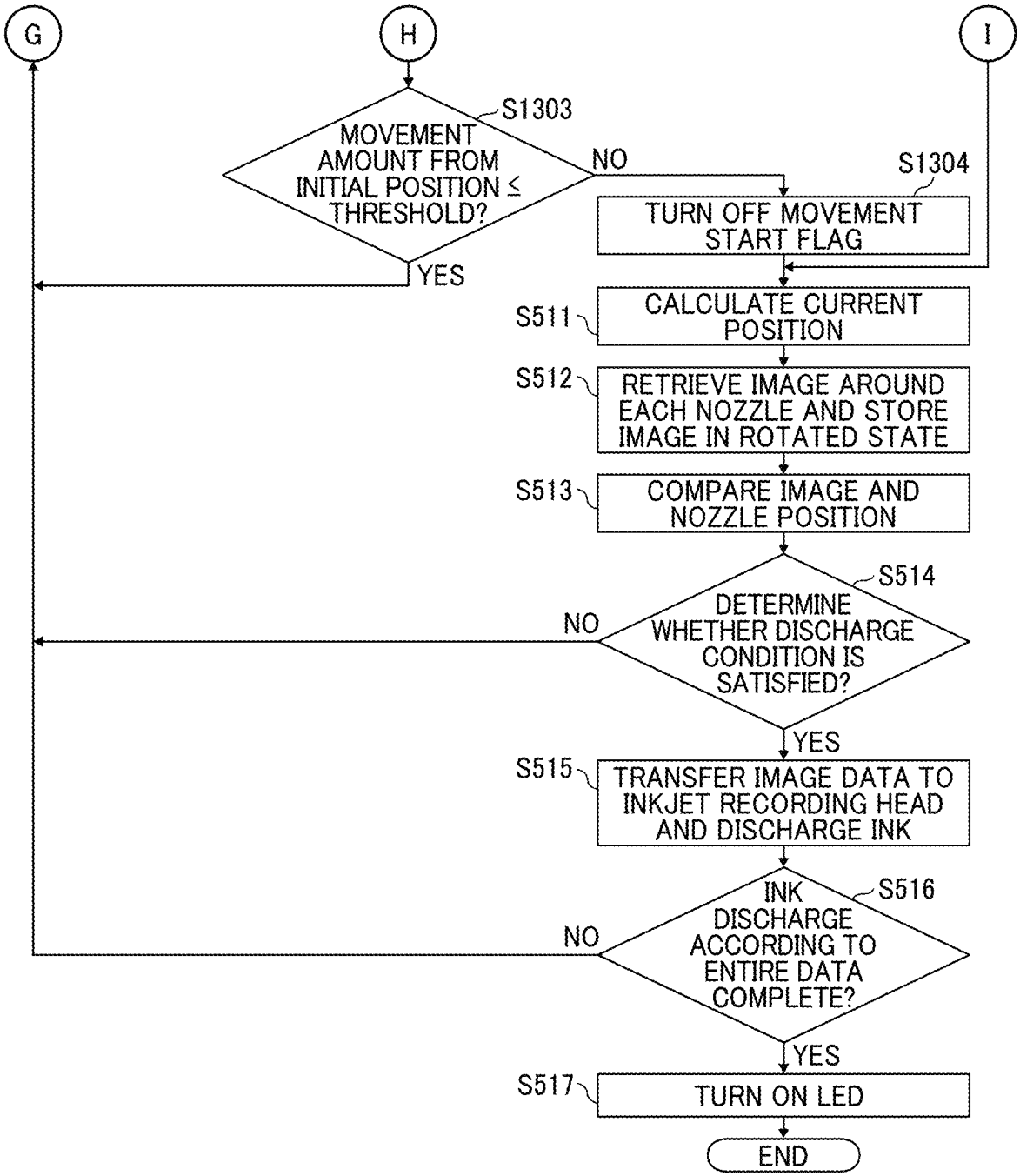

FIGS. 24A and 24B illustrate a flowchart for explaining stopping ink discharge at the start of printing according to the present embodiment. The operation from S601 to S606, and operations from S501 to S506 are respectively similar to the operations from S21 to S26 and the operations S1 to S6 in FIG. 13A. S505-1 is similar to S5-1 in FIG. 13A.

In S1301, the floating-state controller 106 turns on an initial state of a movement start flag indicating start state of movement at the start of printing. The operation from S507 to S510 is similar to the operation from S7 to S10 in FIG. 13A.

In S1302, the floating-state controller 106 determines whether or not the movement start flag is ON. When the movement start flag is ON (Yes in S1302), the process proceeds to S1303. by contrast, when the movement start flag is OFF (No in S1302), the process proceeds to S511.

In S1303, the floating-state controller 106 compares the movement amount from the initial position acquired from the navigation sensor 30 with a predetermined threshold. In response to a comparison result that the movement amount from the initial position is equal to or less than the threshold (Yes in S1303), the process proceeds to S508, and ink discharge is not performed. By contrast, in response to a comparison result that the movement amount from the initial position is greater than the threshold (No in S1303), at S1304, the floating-state controller 106 turns off the movement start flag. Then, the process proceeds to S511 to start ink discharge. The operation after S511 is similar to the operation from S11 illustrated in FIG. 13B.

Executing the flowchart illustrated in FIGS. 24A and 24B is advantageous in that ink discharge can be stopped during the movement start of the handheld printer 10, during which the handheld printer 10 tends to float, according to the information acquired from the navigation sensor 30. That is, the flowchart can be executed without an accelerometer.

The threshold of the movement amount from the initial position referred to in S1303 can be set to a preliminarily verified movement amount with which the floating easily occurs or the movement amount according to an operation of the user.

Figure 25A:
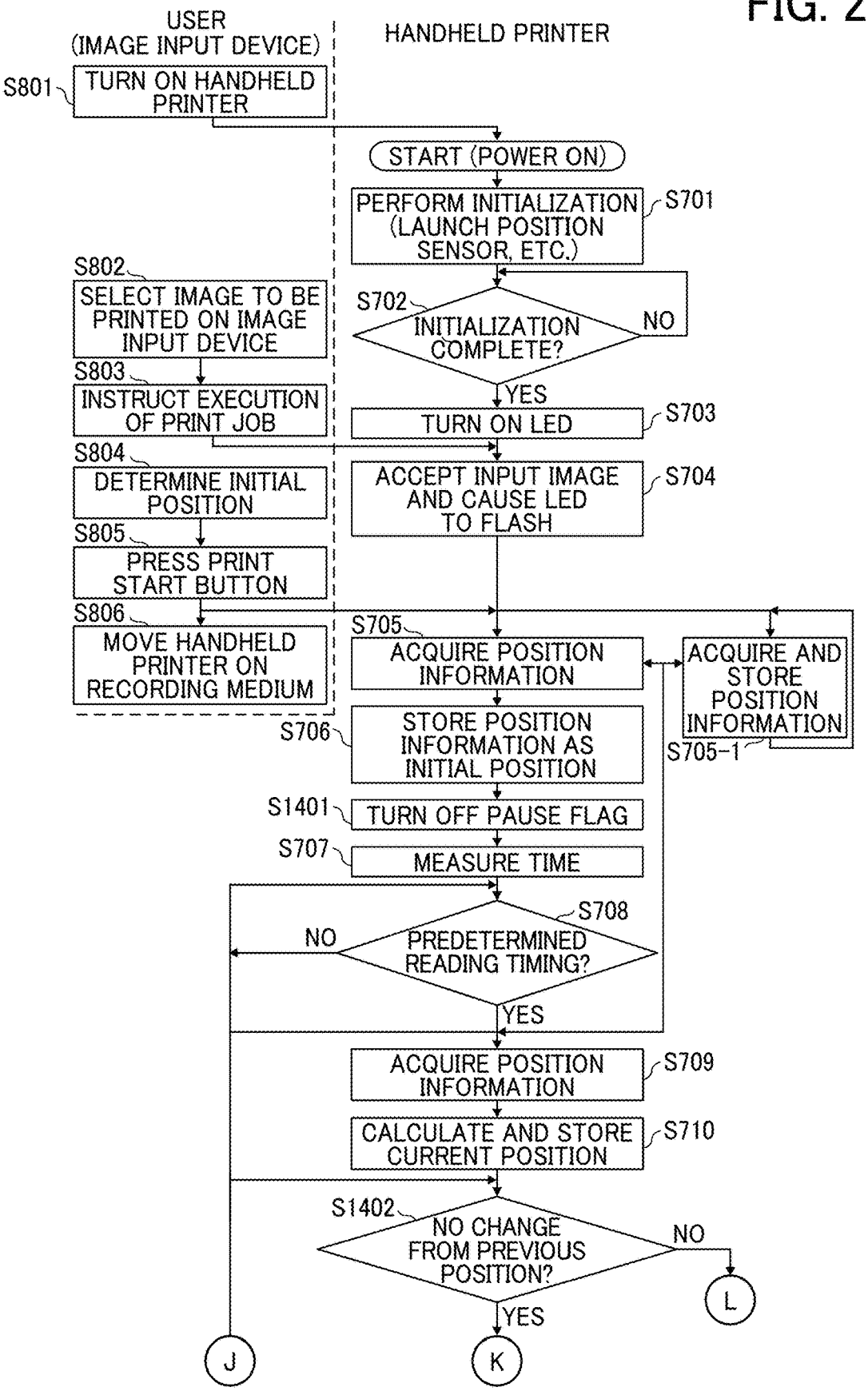
FIG. 25 is divided into FIGS. 25A and 25B and illustrates a flowchart of control operation to stop ink discharge at restart of movement after temporary stop according to an embodiment.
Figure 25B:
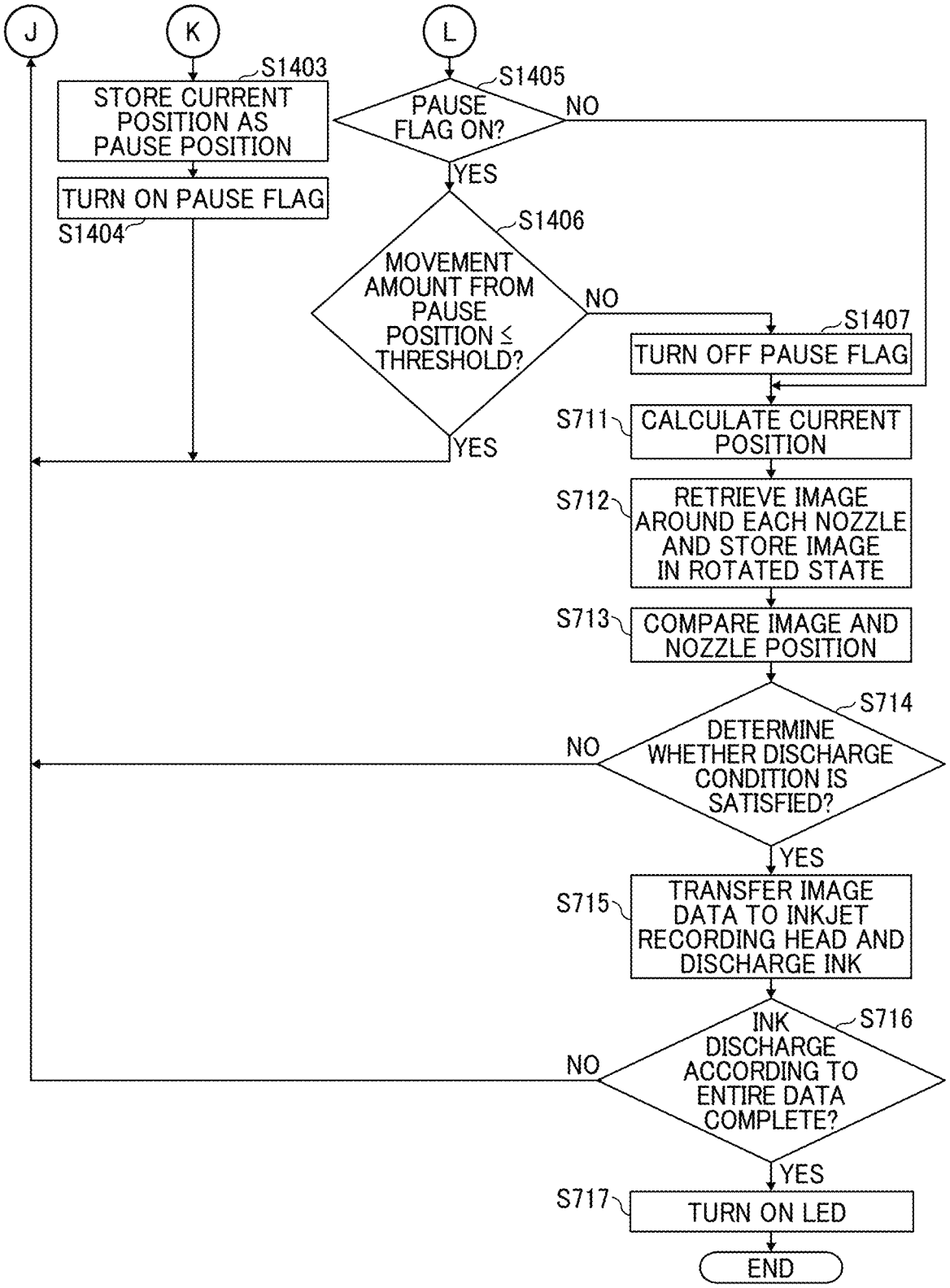

FIGS. 25A and 25B illustrate a flowchart of control operation to stop ink discharge at restart of movement after temporary stop in the present embodiment. The operation from S801 to S806, and operation from S701 to S706 are respectively similar to the operations from S21 to S26 and the operations S1 to S6 in FIG. 13A. S705-1 is similar to S5-1 in FIG. 13A.

In S1401, the floating-state controller 106 turns off an initial state of a pause flag indicating a temporary stop state. The operation from S707 to S710 is similar to the operation from S7 to S10 in FIG. 13A.

In S1402, the floating-state controller 106 determines whether there is a change from the previous position to the current position based on the information acquired from the navigation sensor 30. When the floating-state controller 106 determines there is no change in the current position (Yes in S1402), the process proceeds to S1403. By contrast, when the floating-state controller 106 determines that the current position has changed (No in S1402), the process proceeds to S1405.

In S1403, the floating-state controller 106 stores the current position as a temporary stop position. Subsequently, the floating-state controller 106 turns on the pause flag (S1404), and the process proceeds to S708.

In S1405, the floating-state controller 106 determines whether or not the pause flag is ON. When the pause flag is ON (Yes in S1405), the process proceeds to S1406. When the pause flag is OFF (No in S1405), the process proceeds to S711.

In S1406, the floating-state controller 106 compares the movement amount from the temporary stop position acquired from the navigation sensor 30 with a predetermined threshold. In response to a comparison result that the movement amount from the pause position is equal to or less than the threshold (Yes in S1406), the process proceeds to S708, and ink discharge is not performed. By contrast, in response to a comparison result that the movement amount from the pause position is greater than the threshold (No in S1406), at S1407, the floating-state controller 106 turns off the pause flag. Then, the process proceeds to S711 to start ink discharge. The operation after S711 is similar to the operation after S11 illustrated in FIG. 13B.

Executing the flowchart illustrated in FIGS. 25A and 25B is advantageous in that ink discharge can be stopped at the restart of movement of the handheld printer 10 after a temporary stop, at which the handheld printer 10 tends to float, according to the information acquired from the navigation sensor 30. That is, the flowchart can be executed without an accelerometer.

The threshold of the movement amount from the temporary stop position referred to in S1403 can be set to a preliminarily verified movement amount with which the floating easily occurs or the movement amount according to an operation of the user.

As described above, according to aspects of the present disclosure, the handheld printer 10 determines floating based on the information acquired from the navigation sensor 30 in the freehand scanning, and can stop ink discharge in response to the determination of the floating. In addition, in free hand scanning, the handheld printer 10 can stop ink discharge when the floating-state controller 106 determines the floating based on the information acquired from the accelerometer 20 and the friction sensor 21. Further, in free hand scanning, the handheld printer 10 can stop ink discharge when the floating-state controller 106 determines the floating based on the information acquired from the accelerometer 20 and the predetermined friction coefficient of the recording medium P. Therefore, in the freehand scanning with the handheld printer 10, degradation of print quality can be inhibited even when the handheld printer 10 temporarily floats from the recording medium P.

In the present disclosure, the handheld printer 10 is an example of a droplet discharge apparatus. The inkjet recording head 19 is an example of a head. The image reading unit 105 and the inkjet recording head control unit 110 are examples of a discharge control unit. The floating-state controller 106 is an example of a determination unit, a calculation unit, and a measurement unit. The navigation sensor 30 and the gyro sensor 17 are examples of sensors. The pressure sensor 22 is an example of a pressure detection sensor.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

What is claimed is:

1. An image forming apparatus to form an image on a recording medium according to image data while being moved by a user, the image forming apparatus comprising:

an image forming device to form the image;

a movement amount detector to detect a movement amount of the image forming apparatus in a predetermined period, the movement amount detector includes an optical transmitter and an optical receiver to receive a reflection of light from the recording medium which originated from the optical transmitter;

and a processor configured to:

control image formation by the image forming device based on the image data and the movement amount detected by the movement amount detector; and stop the image formation when the image forming apparatus is determined to be floating when the optical receiver does not receive the reflection of light from the recording medium which originated from the optical transmitter.

2. The image forming apparatus according to claim 1, further comprising an acceleration sensor configured to detect an acceleration applied to the image forming apparatus, wherein the movement amount detector is configured to determine the floating based on the acceleration applied to the image forming apparatus and detected by the acceleration sensor and a friction coefficient of the recording medium.

3. The image forming apparatus according to claim 2, further comprising a friction sensor configured to detect a frictional force of the recording medium, wherein the processor is configured to calculate the friction coefficient based on the friction force detected by the friction sensor.

4. The image forming apparatus according to claim 2, wherein the processor is configured to use a predetermined value of the friction coefficient in determination of the floating.

5. The image forming apparatus according to claim 4, wherein the processor is configured to determine the floating based on force with which the image forming apparatus is pressed against the recording medium.

6. The image forming apparatus according to claim 4, wherein the processor is configured to:

detect a start of movement of the image forming apparatus to resume printing after detecting a temporary stop of printing; and stop image formation in response to detection of the start of movement of the image forming apparatus to resume printing.

7. The image forming apparatus according to claim 2, further comprising a friction sensor configured to detect a frictional force of the recording medium, wherein the processor is configured to calculate the friction coefficient based on the friction force detected by the friction sensor.

8. The image forming apparatus according to claim 1, wherein the processor is configured to:

detect a start of movement of the image forming apparatus at a start of printing, based on the movement amount acquired from the movement amount detector; and stop image formation for a predetermined period in response to detection of the start of movement of the image forming apparatus.

9. The image forming apparatus according to claim 8, further comprising:

a pressure sensor configured to detect the force with which the image forming apparatus is pressed against the recording medium.

10. An image forming method, comprising:

forming an image on a recording medium while moving a printer by a hand of a user;

detecting a movement amount of the printer in a predetermined period, the movement amount being detected by transmitting light and receiving a reflection of light from the recording medium;

controlling image formation by the printer based on image data and the movement amount that has been detected; and stopping the image formation when the printer is determined to be floating when there is no receiving of the reflection of the light from the recording medium when there is the transmitting of light.

11. The method according to claim 10, further comprising:

detecting an acceleration applied to the printer, wherein the stopping stops the image formation when there is detected the acceleration applied to the printer that indicates that the printer is floating.

12. The method according to claim 11, further comprising:

detecting a frictional force of the recording medium using a sensor; and determining a frictional coefficient based on the friction force detected by the sensor.

* * * * *